US006569610B2

(12) United States Patent
Yoshida

(10) Patent No.: US 6,569,610 B2
(45) Date of Patent: May 27, 2003

(54) METHOD FOR PROCESSING SILVER HALIDE COLOR PHOTOSENSITIVE MATERIAL

(75) Inventor: Kazuaki Yoshida, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/084,199

(22) Filed: Feb. 28, 2002

(65) Prior Publication Data

US 2002/0164550 A1 Nov. 7, 2002

(30) Foreign Application Priority Data

Feb. 28, 2001 (JP) ..... 2001-054513

(51) Int. Cl.[7] ..... G03C 7/407
(52) U.S. Cl. ..... 430/434; 430/486
(58) Field of Search ..... 430/434, 486

(56) References Cited

U.S. PATENT DOCUMENTS 5,204,229 A * 4/1993 Nakamura et al. ..... 430/399
5,252,439 A * 10/1993 Nakamura ..... 430/399
5,578,426 A * 11/1996 Nakamura ..... 430/383

FOREIGN PATENT DOCUMENTS

| | | |
|---|---|---|
| JP | 1-230039 | 9/1989 |
| JP | 8-122989 | 5/1996 |

* cited by examiner

*Primary Examiner*—Hoa Van Le
(74) *Attorney, Agent, or Firm*—Sughrue Mion, PLLC

(57) ABSTRACT

A method for processing a silver halide color photosensitive material, comprises developing the silver halide color photosensitive material with a color developer containing a compound represented by formula (I):

$$RSO_2M \quad (I)$$

wherein R represents an alkyl group, a cycloalkyl group, an alkenyl group, an alkynyl group, an aralkyl group or an aryl group; and M represents a hydrogen atom, an alkali metal atom, an ammoniumyl group or a quaternary amino group, wherein the silver halide color photosensitive material is processed in an automatic processor having an air time ratio of 10 to 40% in the color development.

12 Claims, No Drawings

METHOD FOR PROCESSING SILVER HALIDE COLOR PHOTOSENSITIVE MATERIAL

FIELD OF THE INVENTION

This invention relates to a processing method of a silver halide photosensitive material (a silver halide photographic material). More particularly, it relates to a processing method which prevents cut edges of a polyethylene-laminated paper support from being stained.

BACKGROUND OF THE INVENTION

In order to offer rapid development service to customers and to rationalize transport between photography shops and photofinishing laboratories, so-called minilabs having a compact automatic processor have been prevailing. Rapidness of service being of great concern for minilabs, further reduction of processing time has been desired.

If photographic processing is carried out with high concentrate processing solutions at high temperature, aiming to shorten the processing time, processing solutions penetrate from cut edges of a polyethylene-laminated paper support, which is usually used in color printing materials, of processed photographic materials to stain the edges in brown, considerably ruining the value of the prints. The higher the concentration under high temperature and/or high humidity conditions for a long time, the edge stain further propagates with time. It has therefore been a keen demand in the photofinishing market to establish a processing method which suppresses edge staining in consistency with rapid processing.

Use of highly sized paper as a support has been attempted to prevent edge staining. Sizing agents used in photographic paper include those of fatty acid soap type (see JP-B-47-26961) and alkyl ketene dimers (see JP-A-51-132822). However these sizing agents have their several drawbacks and are not satisfactory for use in paper supports for photography. That is, fatty acid soap type sizing agents have poor sizing effects against the alkali of a developing solution, involve appreciable reduction in paper strength with an increased amount added, and also cause reduction in paper stiffness. Alkyl ketene dimers, while having satisfactory sizing effects against neutral water, have low effects against alkaline water or water containing organic solvents such as alcohols, and require a relatively large quantity of polyamidepolyamine epichlorohydrin which is known as a fixing agent. It has therefore been desired to establish a technique which prevents edge stains while using a small amount of a sizing agent so as not to reduce paper strength or stiffness and using a small amount of polyamidepolyamine epichlorohydrin.

SUMMARY OF THE INVENTION

An object of the present invention is to provide a method for processing a silver halide photosensitive material which prevents cut edge staining of a polyethylene-laminated paper support of a processed photographic material.

Another object of the invention is to provide a method for processing a silver halide photosensitive material which achieves a processing time reduction without being accompanied by the edge staining of a processed photographic material.

The above objects of the invention are accomplished by the following.

(1) A method for processing a silver halide color photosensitive material, which comprises developing the silver halide color photosensitive material with a color developer containing a compound represented by formula (I):

$$RSO_2M \quad \text{(I)}$$

wherein R represents an alkyl group, a cycloalkyl group, an alkenyl group, an alkynyl group, an aralkyl group or an aryl group; and M represents a hydrogen atom, an alkali metal atom, an ammoniumyl group or a quaternary amino group, wherein the silver halide color photosensitive material is processed in an automatic processor having an air time ratio of 10 to 40% in the color development.

(2) The method for processing a silver halide color photosensitive material according to the item (1), wherein R in formula (I) represents an aryl group containing a carboxyl group.

(3) The method for processing a silver halide color photosensitive material according to the item (1), wherein the compound represented by formula (I) is a compound represented by formula (I-a):

(I-a)

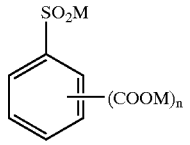

wherein M represents a hydrogen atom, an alkali metal atom, an ammoniumyl group or a quaternary amino group; and n represents an integer of 1 to 5.

(4) The method for processing a silver halide color photosensitive material according to the item (1), wherein the compound represented by formula (I-a) is at least one of m-carboxybenzenesulfinic acid and a salt of m-carboxybenzenesulfinic acid.

(5) The method for processing a silver halide color photosensitive material according to the item (1), wherein the color developer contains the compound represented by formula (I) in an amount of 0.001 to 1 mol per liter of the color developer.

(6) The method for processing a silver halide color photosensitive material according to the item (1), wherein the air time ratio is 15 to 40%.

(7) The method for processing a silver halide color photosensitive material according to the item (1), wherein the air time ratio is 30 to 40%.

(8) The method of processing a silver halide color photosensitive material according to the item (1), wherein the air time ratio (%) in the color development is defined by formula: $(T2/T1)\cdot 100$, wherein T1 represents a time period from the immersion of the silver halide color photosensitive material in the color developer to the immersion of the silver halide color photosensitive material in a processing solution of the next processing step; T2 represents a time period from the time at which the silver halide color photosensitive material comes out of the color developer to the immersion of the silver halide color photosensitive material in a processing solution of the next processing step.

(9) The method for processing a silver halide color photosensitive material according to the item (1), wherein the automatic processor has a transport speed of 20 to 50 mm/sec.

(10) The method for processing a silver halide color photosensitive material according to the item (1), wherein the silver halide color photosensitive material comprises a paper support having a water-resistant resin layer.

(11) The method of processing a silver halide color photosensitive material according to the item (10), wherein the water-resistant resin layer is a polyethylene layer.

(12) The method for processing a silver halide color photosensitive material according to the item (1), wherein the silver halide color photosensitive material is a photosensitive material for a color printing paper.

To add the compound of formula (I) to a photographic processing solution is disclosed in JP-A-1-230039. An automatic processor capable of meeting the condition of an air time ratio of 10 to 40% is known as taught in JP-A-8-122989. Nevertheless, neither of these techniques alone offers accomplishment of the above objects. It is not until these techniques are combined that the objects of the present invention are fulfilled. That is, it has been found that edge staining is prevented, and speeding-up of processing is achieved by processing in an automatic processor at an air time ratio of 10 to 40% in the color development step and by using a color developer containing the compound of formula (I). A combination of the specific developing solution and the specific condition of an automatic processor is unknown, and it is findings first reached by the present inventors that the combination results in prevention of edge staining. The present invention has thus been completed based on the findings. Having succeeded in preventing edge staining, the present invention makes it possible to appreciably reduce a processing time without impairing a commercial value of photographic materials.

DETAILED DESCRIPTION OF THE INVENTION

[I] Developing Solution

In formula (I), Rrepresents an alkyl group, a cycloalkyl group, an alkenyl group, an alkynyl group, an aralkyl group or an aryl group. The alkyl group preferably has 1 to 10, particularly 1 to 3, carbon atoms. The cycloalkyl group preferably has 6 to 10, particularly 6, carbon atoms. The alkenyl group and the alkynyl group preferably have 3 to 10, particularly 3 to 6, carbon atoms. The aralkyl group preferably has 7 to 10 carbon atoms. The aryl group preferably has 6 to 10, particularly 6, carbon atoms. These groups may have substituents. Suitable substituents include a hydroxyl group, an amino group, a sulfonic acid group, a carboxyl group, a nitro group, a phosphoric acid group, a halogen atom, an alkoxy group, a mercapto group, a cyano group, an alkylthio group, a sulfonyl group, a carbamoyl group, a carbonamido group, a sulfonamido group, an acyloxy group, a sulfonyloxy group, a ureido group, and a thioureido group. Of these substituents those having an acid radical may have a form of a salt carrying M (≠H).

R is preferably an alkyl group having 1 to 3 carbon atoms or a phenyl group, which may be substituted. Preferred substituents include an amino group, a carboxyl group, and a hydroxyl group.

M in formulae (I) and (I-a) represents a hydrogen atom, an alkali metal atom, an ammoniumyl group or a quaternary amino group. M preferably represents a hydrogen atom, a sodium atom, a potassium atom, an ammoniumyl group or a trimethylammoniumyl group.

n in formula (I-a) is preferably 1, 2 or 3, still preferably 1.

Of the compounds represented by formula (I), those of formula (I-a) are especially effective. In particular, m-carboxybenzenesulfinic acid or a salt thereof or a mixture thereof is preferred.

Specific examples of the compound (I) include, but are not limited to, the following compounds. While the compounds listed below have their sulfinic acid or carboxylic acid group mostly in the form of a neutral salt, they may take other salt forms as defined with respect to M.

I-1

$CH_3SO_2H$

I-2

$CH_3SO_2Na$

I-3

$CH_3SO_2K$

I-4

$C_2H_5SO_2H$ 1-5

$C_2H_5SO_2Na$

I-6

$H_2NCH_2CH_2SO_2H$

I-7

$H_2NCH_2CH_2SO_2Na$

I-8

$H_3\overset{+}{N}CH_2CH_2SO_2^-$

I-9

$HOCH_2CH_2SO_2Na$

I-10

$HOCH_2CH_2SO_2H$

I-11

$HOOCCH_2CH_2SO_2Na$

I-12

$H_4NOOCCH_2CH_2SO_2H$

I-13

$F_3CSO_2H$

I-14

$NaSO_2CH_2CH_2SO_2Na$.

I-15

$H_2N\overset{\overset{NH}{\|}}{C}NHCH_2CH_2SO_2H$

I-16

$CH_3\overset{\overset{OH}{|}}{C}HSO_2K$

I-17

$CH_3\overset{\overset{OH}{|}}{C}HSO_2H$

I-18

$HOOC-\overset{\overset{NH_2}{|}}{C}HCH_2SO_2Na$

I-19

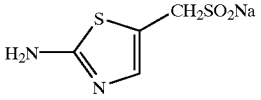

I-20

$CH_3SO_2Li$

I-21

$HOOC\overset{\overset{NH_2}{|}}{C}HCH_2SO_2H$

I-22

$CH_3SO_2^-\overset{+}{N}(CH_3)_4$

I-23

$H_3C-\overset{\overset{CH_3}{|}}{\overset{+}{N}}(\overset{\overset{CH_3}{|}}{})CH_2CH_2SO_2^-$

I-24

$H_2NCH_2CH_2\overset{\overset{NH_2}{|}}{C}HCH_2SO_2H$

-continued

I-25

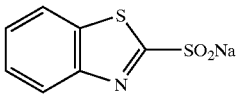

I-26

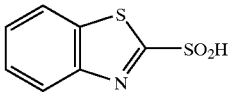

I-27 $C_3H_7SO_2H$

I-28 $C_3H_7SO_2Na$

I-29 $C_4H_9SO_2H$

I-30 $C_6H_{13}SO_2Na$

I-31 $CH_3CONHCH_2SO_2H$

I-32

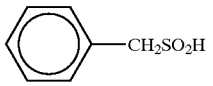

I-33

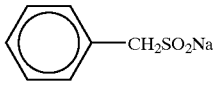

I-34

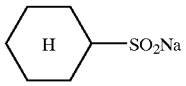

I-35

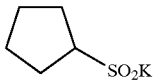

I-36

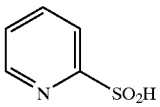

I-37

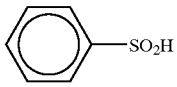

I-38

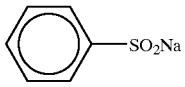

I-39

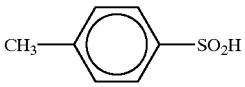

I-40

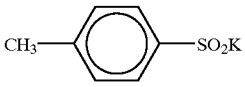

I-41 $CH_3CH(CH_3)CH_2SO_2Na$

I-42

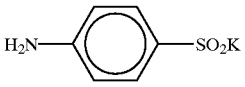

I-43

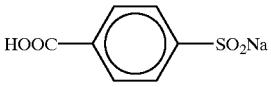

-continued

I-44

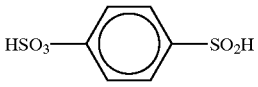

I-45 $CH_2{=}CHCH_2SO_2Na$

I-46

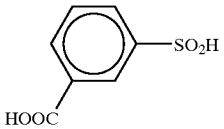

I-47

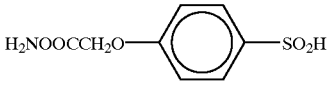

I-48

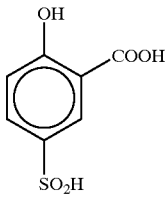

I-49

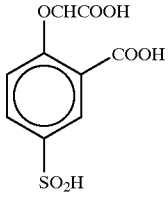

I-50

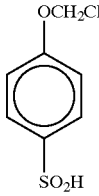

I=51

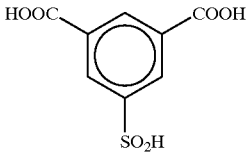

Particularly preferred of the above list are compounds I-46, I-43 and I-51. Compound I-46 is the most preferred.

The compound of formula (I) is generally synthesized by reduction of a sulfonyl chloride compound. Usable reducing agents include zinc powder, sulfite ions, and alkali metal sulfides. Other synthesis methods are also known. For the details of synthesis including the above-described method, refer to *Chem. Rev.*, vol. 4508, p. 69 (1951), *Organic Synthesis*, Collective Vol. I, p. 492 (1941), *J. Am. Chem. Soc.*, vol. 72, p. 1215 (1950), ibid., vol. 50, p. 792 and 274 (1928), etc.

The compound of formula (I) is added in an amount usually of from 0.001 to 1 mol, preferably of from 0.01 to 0.5 mol, per liter of a color developer. The compound of formula (I) can be synthesized by, for example, the process taught in JP-A-62-1430488 or its analogous processes. Some of the compounds (I) are commercially available. The details of the other components making up a color developer will be described later.

As stated above, the compound of formula (I) are known as a group of sulfinic acid compounds, which are useful in a bleach-fix bath as described in JP-A-1-224762 and JP-A-2-91643. However, it has been utterly unknown that edge staining of a paper support could be prevented by using a color developer containing this compound in an automatic processor under a specific condition.

The photographic processing method according to the present invention is characterized by using an automatic processor at an air time ratio of 40% or smaller. A preferred air time ratio is 10 to 40%, particularly 15 to 40%, especially 30 to 40%.

The terminology "air time ratio" as used herein denotes a ratio of the time during which a photosensitive material exists in air to a time period in a processing step from immersing the material in a processing solution to immersing the material in a processing solution of a next step. The "air time ratio" in the color development is a percentage of time T2 (air time) from the time at which an end of a photosensitive material comes out of a color developer to the time at which the same end enters another processing solution of the next step (e.g., a bleaching solution, a bleach-fixing solution or a stop solution) to time T1 from the time at which the same end enters the color developer to the time at which the same end enters the other processing solution, i.e., T2/T1 (%). In cases where a photosensitive material is transported in air within a processing step, for example, where the processing step is carried out using two or more tanks, or where a plurality of racks are used and a photosensitive material is transferred from one rack to the other, the time in which the photosensitive material stays in air is also included in the air time T2.

The components making up the color developer other than the compound (I) are described hereunder.

Color developing agents preferably include known aromatic primary amine color developing agents, particularly p-phenylenediamine derivatives. The following is a list of typical but non-limiting examples of the p-phenylenediamine developing agents.

1) N,N-Diethyl-p-phenylenediamine
2) 4-Amino-3-methyl-N,N-diethylaniline
3) 4-Amino-N-(β-hydroxyethyl)-N-methylaniline
4) 4-Amino-N-ethyl-N-(β-hydroxyethyl)aniline
5) 4-Amino-3-methyl-N-ethyl-N-(β-hydroxyethyl)aniline
6) 4-Amino-3-methyl-N-ethyl-N-(3-hydroxypropyl)aniline
7) 4-Amino-3-methyl-N-ethyl-N-(4-hydroxybutyl)aniline
8) 4-Amino-3-methyl-N-ethyl-N-(β-methanesulfonamidoethyl)aniline
9) 4-Amino-N,N-diethyl-3-(β-hydroxyethyl)aniline
10) 4-amino-3-methyl-N-ethyl-N-(β-methoxyethyl)aniline
11) 4-Amino-3-methyl-N-(β-ethoxyethyl)-N-ethylaniline
12) 4-Amino-3-methyl-N-(3-carbamoylpropyl)-N-n-propylaniline
13) 4-Amino-N-(4-carbamoylbutyl)-N-n-propyl-3-methylaniline
14) N-(4-Amino-3-methylphenyl)-3-hydroxypyrrolidine
15) N-(4-Amino-3-methylphenyl)-3-(hydroxymethyl) pyrrolidine
16) N-(4-Amino-3-methylphenyl)-3-pyrrolidinecarboxamide Preferred of the p-phenylenediamine derivatives are compounds (5) to (8) and (12), with compounds (5) and (8) being particularly preferred. When supplied in a solid form, they are usually available as a salt, such as a sulfate, a hydrochloride, a sulfite, a naphthalenedisulfonate or a p-toluenesulfonate. The aromatic primary amine developing agent is usually used in concentrations of 2 to 200 mmol, preferably 6 to 100 mmol, still preferably 10 to 40 mmol, per liter of a developing solution.

A color developer contains a small amount of sulfite ions or contains substantially no sulfite ions, which depends on the kind of a photosensitive material to be processed. Presence of a small amount of sulfite ions is preferred in the invention. Sulfite ions exhibit an appreciable preservative action for a developing solution but can adversely affect the photographic performance during color development when used in excess.

The color developer can contain a small amount of hydroxylamine (hydroxylamine is usually added in the form of a hydrochloride or a sulfate, but the salt moiety is hereunder omitted from its description). Hydroxylamine serves as a preservative for a developing solution similarly to sulfite ions but can influence the photographic characteristics on account of its own silver developing activity. The amount of hydroxylamine to be added should therefore be minimized.

The color developer can further contain organic preservative in addition to hydroxylamine and sulfite ions. The organic preservatives include general organic compounds which retard deterioration of the aromatic primary amine color developing agents, namely organic compounds which function in protecting color developing agents against aerial oxidation when added to a developing solution. Particularly effective organic preservatives include the above-mentioned hydroxylamine derivatives, hydroxamic acids, hydrazide derivatives, phenol derivatives, α-hydroxyketone derivatives, α-aminoketone derivatives, saccharides, monoamines, diamines, polyamines, quaternary ammonium salts, nitroxyl radical compounds, alcohols, oximes, diamide compounds, and condensed cyclic amines. These compounds are disclosed in JP-A-63-4235, JP-A-63-30845, JP-A-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503 and 2,494,903, JP-A-52-143020, and JP-B-48-30496.

Other preservatives, such as various metals described in JP-A-57-44148 and JP-A-57-53749, salicylic acid compounds described in JP-A-59-180588, alkanolamines described in JP-A-54-3532, polyethyleneimine compounds described in JP-A-56-94349, aromatic polyhydroxy compounds described in U.S. Pat. No. 3,746,544, and the like, can be added if desired.

In particular, addition of alkanolamines, such as triethanolamine and triisopropanolamine; substituted or unsubstituted dialkylhydroxylamines, such as disulfoethylhydroxylamine and diethylhydroxylamine; or aromatic polyhydroxy compounds is preferred.

Of the above-mentioned organic preservatives, the details of the hydroxylamine derivatives are described in JP-A-1-97953, JP-A-1-186939, JP-A-1-186940, and JP-A-1-187557. A combined use of a hydroxylamine derivative and an amine can be effective for improvements in stability of a color developer and continuous processing stability. The amine includes cyclic amines described in JP-A-63-239447, amines described in JP-A-63-128340, and amines described in JP-A-1-186939 and JP-A-1-187557. While varying according to the kinds, the concentration of the preservatives in the developing solution is usually 1 to 200 mmol, preferably 10 to 100 mmol, per liter.

Where necessary, the color developer contains chloride ions. A color developer, especially for color printing paper, often contains $3.5\times10^{-2}$ to $1.5\times10^{-1}$ mol/l of chloride ions. Addition of chloride ions to a replenisher for a developing solution is often unnecessary because chloride ions are usually released into a developing solution as by-products of development. Developing solutions for photosensitive materials for photographing do not need to contain chloride ions.

A bromide ion concentration in a color developer is about 1 to $5\times10^{-3}$ mol/l for photosensitive materials for photographing and $1.0\times10^{-3}$ mol/l or less for printing materials. Addition of bromide ions to a color developer is often unnecessary. Where added, bromide ions are added in the above-recited concentration.

Where the photosensitive materials to be processed are those prepared from silver iodobromide emulsions, such as color negative films and color reversal films, the above description about chloride ions and bromide ions applies to iodide ions. Usually, iodide ions are not added to a replenisher because iodide ions are released from the photo sensitive material into the developing solution to provide a iodide ion concentration of about 0.5 to 10 mg per liter.

Where halides are added to a developing solution or a replenisher as a source of chloride, bromide or iodide ions, chloride ion sources include sodium chloride, potassium chloride, ammonium chloride, lithium chloride, nickel chloride, magnesium chloride, manganese chloride and calcium chloride, with sodium chloride and potassium chloride being preferred. Bromide ion sources include sodium bromide, potassium bromide, ammonium bromide, lithium bromide, calcium bromide, magnesium bromide, manganese bromide, nickel bromide, cerium bromide, and thallium bromide, with potassium bromide and sodium bromide being preferred. Iodide ion sources include sodium iodide and potassium iodide.

Both the color developer and a replenisher thereof used in the present invention are preferably adjusted to a pH of 9.0 to 13.5. An alkali, a buffering agent or, if necessary, an acid is added for this purpose. The pH adjustment is preferably effected by the use of buffering agents. Useful buffering agents include carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts, and lysine salts. Carbonates, phosphates, tetraborates and hydroxybenzoates are particularly preferred; for they are superior in buffering capacity in a high pH region of 9.0 or higher, give no adverse influences on photographic performance (e.g., fog) when added to color developers, and are inexpensive.

Useful buffering agents include, but are not limited to, sodium carbonate, potassium carbonate, sodium hydrogencarbonate, potassium hydrogencarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate).

The buffering agents, not being consumed as a reactant, are added to a developing solution or a replenisher as prepared from a prepared chemical in a concentration of 0.01 to 2.0 mol, preferably 0.1 to 0.5 mol, per liter.

The color developer can contain a chelating agent which functions as an agent for preventing precipitation of calcium or magnesium or as an agent for improving stability of the developing solution. Examples of useful chelating agents are nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, trans-cyclohexanediaminetetraacetic acid, 1,2-diaminopropanetetraacetic acid, glycol ether diaminetetraacetic acid, ethylenediamine-o-hydroxyphenylacetic acid, ethylenediaminedisuccinic acid (SS-form), N-(2-carboxylatoethyl)-L-aspartic acid, β-alaninediacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid, and 1,2-dihydroxybenzene-4,6-disulfonic acid. These chelating agents may be used either individually or as a combination of two or more thereof. The chelating agents are used in an amount sufficient for sequestering metallic ions in a prepared color developer, for example, about 0.1 to 10 g per liter.

If desired, the color developer can further contain developing accelerators. Useful developing accelerators include thioether compounds described in JP-B-37-16088, JP-B-37-5987, JP-B-38-7826, JP-B-44-12380, JP-B-45-9019, and U.S. Pat. No. 3,813,247; p-phenylenediamine compounds described in JP-A-52-49829 and JP-A-50-15554; quaternary ammonium salts described in JP-A-50-137726, JP-B-44-30074, JP-A-56-156826, and JP-A-52-43429; amine compounds described in U.S. Pat. Nos. 2,494,903, 3,128,182, 4,230,796, and 3,253,919, JP-B-41-11431, and U.S. Pat. Nos. 2,482,546, 2,596,926, and 3,582,346; polyalkylene oxides described in JP-B-37-16088, JP-B-42-25201, U.S. Pat. No. 3,128,183, JP-B-41-11431, JP-B-42-238883, and U.S. Pat. No. 3,532,501; 1-phenyl-3-pyrazolidone derivatives; imidazole derivatives; and the like. The developing accelerators are added in a concentration of 0.001 to 0.2 mol, preferably 0.01 to 0.05 mol, per liter of a prepared developing solution and a prepared replenisher therefor.

If desired, the color developer can contain an antifoggant of choice. Useful antifoggants include the aforementioned halides and organic antifoggants, typically nitrogen-containing heterocyclic compounds, such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolidine, and adenine.

If desired, the color developer can contain surface active agents. Usable surface active agents include alkylsulfonic acids, arylsulfonic acids, aliphatic carboxylic acids, and aromatic carboxylic acids. The amount of the surface active agents is decided so as to give a concentration of 0.0001 to 0.2 mol, preferably 0.001 to 0.05 mol, per liter of a developing solution and a replenisher therefor as prepared from a prepared chemical.

If desired, the color developer can a contain fluorescent whitening agent. Useful fluorescent whitening agents include bis(triazinylamino)stilbenesulfonic acid compounds. Known or commercially available bis(triazinylamino)stilbene whitening agents can be used. For example, the compounds described in JP-A-6-329936, JP-A-7-140625 and JP-A-10-140849 are preferred. Commercially available compounds are listed, e.g., in *Sensyoku Note,* 9th ed., pp. 165–168, Shikisensya. Particularly preferred of the commercially available compounds are Blankophor BSU liq. and Hakkol BRK.

If desired, a bis(3,5-diamino-2,4,6-triazinylamino)arylene compound represented by formula (U) shown below can be added to the developing solution.

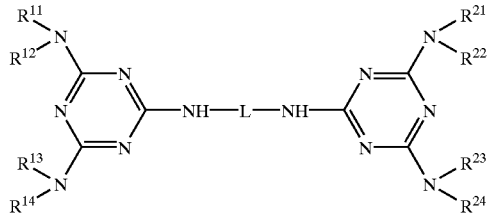

(U)

wherein $R^{11}$, $R^{12}$, $R^{13}$, $R^{14}$, $R^{21}$, $R^{22}$, $R^{23}$, and $R^{24}$ each represent a hydrogen atom, an alkyl group, an aryl group or a heterocyclic group; L represents a phenylene group or a naphthylene group; and adjacent groups $R^{11}$ and $R^{12}$, adjacent groups $R^{13}$ and $R^{14}$, adjacent groups $R^{21}$ and $R^{22}$, and/or adjacent groups of $R^{23}$ and $R^{24}$ may be connected to each other to form a ring; with proviso that the molecule has at least one of —$SO_3M$, —$CO_2M$ and —OH, wherein M represents a hydrogen atom, an alkali metal atom, an alkaline earth metal atom, an ammoniumyl group or a pyridiniumyl group, that three or more out of $R^{11}$, $R^{12}$, $R^{13}$, $R^{14}$, $R^{21}$, $R^{22}$, $R^{23}$, and $R^{24}$ do not represent an aryl group simultaneously, that one or more of $R^{11}$, $R^{12}$, $R^{13}$ and $R^{14}$ and one or more of $R^{21}$, $R^{22}$, $R^{23}$, and $R^{24}$ are not connected to each other to form a ring, and that the molecule does not have a group —N═N—.

In formula (U), the alkyl group as represented by $R^{11}$, $R^{12}$, $R^{13}$, $R^{14}$, $R^{21}$, $R^{22}$, $R^{23}$, and $R^{24}$ is a substituted or unsubstituted alkyl group having 1 to 20, preferably 1 to 8, still preferably 1 to 4, carbon atoms, such as methyl, ethyl, isopropyl, n-propyl, n-octyl, sulfomethyl, 2-hydroxyethyl, 3-hydroxypropyl, 2-hydroxypropyl, 2-sulfoethyl, 2-methoxyethyl, 2-(2-hydroxyethoxy) ethyl, 2-[2-(2-hydroxyethoxy)ethoxy] ethyl, 2-(2-[2-(2-hydroxyethoxy) ethoxy] ethoxy)ethyl, 2,3-dihydroxypropyl, 3,4-dihydroxybutyl, and 2,3,4,5,6-pentahydroxyhexyl.

The aryl group as represented by $R^{11}$, $R^{12}$, $R^{13}$, $R^{14}$, $R^{21}$, $R^{22}$, $R^{23}$, and $R^{24}$ is a substituted or unsubstituted aryl group having 6 to 20, preferably 6 to 10, still preferably 6 to 8, carbon atoms, such as phenyl, naphthyl, 3-carboxyphenyl, 4-carboxyphenyl, 3,5-dicarboxyphenyl, 4-methoxyphenyl, 2-sulfophenyl, and 4-sulfophenyl. The heterocyclic group as represented by $R^{11}$, $R^{12}$, $R^{13}$, $R^{14}$, $R^{21}$, $R^{22}$, $R^{23}$, and $R^{24}$ is a substituted or unsubstituted heterocyclic group having 2 to 20, preferably 2 to 10, still preferably 3 to 8, carbon atoms which is derived by removing one hydrogen atom from a 5-or 6-membered aromatic or non-aromatic heterocyclic compound, such as 2-thienyl, 2-pyrimidinyl and 2-benzothiazolyl.

$R^{11}$, $R^{12}$, $R^{13}$, $R^{14}$, $R^{21}$, $R^{22}$, $R^{23}$, and $R^{24}$ each preferably represent a hydrogen atom, an alkyl group or an aryl group; still preferably a hydrogen atom, a methyl group, an ethyl group, an n-propyl group, a sulfomethyl group, a 2-hydroxyethyl group, a 3-hydroxypropyl group, a 2-hydroxypropyl group, a 2-sulfoethyl group, a 2-methoxyethyl group, a 2-(2-hydroxyethoxy)ethyl group, a 2-[2-(2-hydroxyethoxy)ethoxy]ethyl group, a 2,3-dihydroxypropyl group, a 3,4-dihydroxybutyl group, a phenyl group, a 3-carboxyphenyl group, a 4-carboxyphenyl group, a 3,5-dicarboxyphenyl group, a 4-methoxyphenyl group, a 2-sulfophenyl group or a 4-sulfophenyl group; particularly preferably a hydrogen atom, a methyl group, an ethyl group, a sulfomethyl group, a 2-hydroxyethyl group, a 2-sulfoethyl group, a 2-(2-hydroxyethoxy) ethyl group, a 2,3-dihydroxypropyl group, a phenyl group, a 3-carboxyphenyl group, a 4-carboxyphenyl group, a 2-sulfophenyl group or a 4-sulfophenyl group; especially preferably a hydrogen atom, a methyl group, a sulfomethyl group, a 2-hydroxyethyl group, a 2-sulfoethyl group, a 2-(2-hydroxyethoxy) ethyl group, a 2,3-dihydroxypropyl group, a phenyl group or a 4-sulfophenyl group.

The phenylene group or naphthylene group as represented by L is a substituted or unsubstituted phenylene or naphthylene group having 6 to 20, preferably 6 to 15, still preferably 6 to 11, carbon atoms, such as 1,4-phenylene, 1,3-phenylene, 1,2-phenylene, 1,5-naphthylene, 1,8-naphthylene, 4-carboxy-1,2-phenylene, 5-carboxy-1,3-phenylene, 3-sulfo-1,4-phenylene, 5-sulfo-1,3-phenylene, 2,5-dimethoxy-1,4-phenylene or 2,6-dichloro-1,4-phenylene.

L preferably represents 1,4-phenylene, 1,3-phenylene, 1,2-phenylene, 1,5-naphthylene, 5-carboxy-1,3-phenylene or 5-sulfo-1,3-phenylene. L still preferably represents 1,4-phenylene or 1,3-phenylene.

The ring formed by $R^{11}$ connected to $R^{12}$, $R^{13}$ connected to $R^{14}$, $R^{21}$ connected to $R^{22}$, or $R^{23}$ connected to $R^{24}$ is preferably a 5- or 6-membered ring, such as a pyrrolidine ring, a piperidine ring, a piperazine ring or a morpholine ring.

Of the alkali metals and alkaline earth metals represented by M preferred are Na and K. The ammoniumyl group as M includes an ammoniumyl group, a triethylammoniumyl group, and a tetrabutyl ammoniumyl group. M most preferably represents Na or K.

[II] Other Processing Solutions

Processing solutions used for desilvering, i.e., a bleach-fixing solution or a combination of a bleaching solution and a fixing solution, are then described, starting with bleaching agents for a bleaching solution and a bleach-fixing solution. Known bleaching agents can be used in a bleaching solution or a bleach-fixing solution. Preferred bleaching agents include organic complex salts of iron (III) (e.g., aminopolycarboxylates), organic acids, e.g., citric acid, tartaricacidandmalicacid, persulfates, and hydrogenperoxide.

The organic complex salts of iron (III), especially those of aminopolycarboxylic acids, are particularly preferred from the standpoint of suitability to rapid processing and environmental conservation. Examples of useful aminopolycarboxylic acids are ethylenediaminesuccinic acid (SS-form), N-(2-carboxylatoethyl)-L-aspartic acid, β-alaninediacetic acid, and methyliminodiacetic acid, which are biodegradable; ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, iminodiacetic acid, and glycol ether diaminetetraacetic acid. These compounds may have a salt form with sodium, potassium, lithium or ammonium. Of these compounds preferred are ethylenediaminedisuccinic acid (SS-form), N-(2-carboxylatoethyl)-L-aspartic acid, β-alaninediacetic acid, ethylenediaminetetraacetic acid, 1,3-diaminopropanetetraacetic acid, and methyliminodiacetic acid; for the iron (III) complex salts formed by using these compounds bring about satisfactory photographic characteristics. The iron (III) complex salts may be supplied as such or formed in situ by addition of a ferric salt (e.g., ferricsulfate, ferricchloride, ferricnitrate, ammoniumferric sulfate, ferric phosphate, etc.) and a chelating agent, such as an aminopolycarboxylic acid. The chelating agent can be added in excess over the amount necessary for forming the ferric ion complex salt.

The amount of the bleaching agent to be added is decided so as to give a concentration of 0.01 to 1.0 mol, preferably 0.03 to 0.80 mol, still preferably 0.05 to 0.70 mol, particularly preferably 0.07 to 0.50 mol, per liter of a prepared processing solution.

It is preferred for the bleaching solution, bleach-fixing solution or fixing solution to contain various known organic acids (e.g., glycolic acid, succinic acid, maleic acid, malonic acid, citric acid, and sulfosuccinic acid) or organic bases (e.g., imidazole and dimethylimidazole), the compounds disclosed in JP-A-9-211819, being represented by formula (A-a) and typified by 2-picolinic acid, or the compounds disclosed in the same publication, being represented by formula (B-b) and typified by kojic acid. These compounds are preferably added in a concentration of 0.005 to 3.0 mol, particularly 0.05 to 1.5 mol, per liter of a prepared processing solution.

The bleach-fixing solution and a fixing solution contain one or more known fixing agents, i.e., water-soluble silver halide solvents, such as thiosulfates (e.g., sodium thiosulfate and ammonium thiosulfate), thiocyanates (e.g., sodium thiocyanate and ammonium thiocyanate), thioether compounds (e.g., ethylenebisthioglycolic acid and 3,6-dithia-1,8-octanediol), and thioureas. A special bleach-fixing solution containing a fixing agent and a large quantity of a halide, e.g., potassium iodide, as disclosed in JP-A-55-155354, is also useful. In the present invention thiosulfates, especially ammonium thiosulfate, are preferred. The fixing agent is used preferably in a concentration of 0.3 to 3 mol, particularly 0.5 to 2.0 mol, per liter of a prepared processing solution.

While the bleach-fixing or fixing solution is dissolving silver halide, the pH of the solution is preferably kept between 3 and 8, still preferably 4 and 8. At a lower pH the desilvering performance is enhanced, but deterioration of the solution and reduction of cyan dyes are accelerated. At a higher pH desilvering is retarded, and staining can easily result.

The pH of the bleaching solution prepared from, for example, a granular prepared chemical, is 8 or lower, preferably 2 to 7, still preferably 2 to 6. At a lower pH, deterioration of the solution and reduction of a cyan dye are accelerated. At a higher pH desilvering is retarded, and staining can easily result.

For pH adjustment, the above-recited solids acids, solids alkalis (e.g., potassium hydroxide, sodium hydroxide, lithium hydroxide, lithium carbonate, sodium carbonate, and potassium carbonate), acidic or alkaline buffering agents, and the like can be used.

The bleach-fixing solution can further contain fluorescent whitening agents, antifoaming agents, surface active agents, organic solvents (e.g., polyvinylpyrrolidone), etc. As previously described, the fluorescent whitening agent may be incorporated into a prepared chemical in such an amount to give a concentration of 0.02 to 1.0 mol per liter of a developing solution prepared there from.

The bleach-fixing or fixing solution preferably contains, as a preservative, sulfite ion-releasing compounds, such as sulfites (e.g., sodium sulfite, potassium sulfite, ammonium sulfite), bisulfites (e.g., ammoniumhydrogensulfite, sodium hydrogensulfite, potassium hydrogensulfite), and metabisulfites (e.g., sodium metabisulfate, potassium metabisulfite, ammoniummetabisulfite); or arylsulfinic acids, such as p-toluenesulfinic acid and m-carboxybenzenesulfinic acid. These compounds are preferably used in a concentration of about 0.02 to 1.0 mol/l in terms of sulfite ions or sulfinate ions. Ascorbic acid, a carbonyl/bisulfite addition compound or a carbonyl compound is also useful as a preservative.

After desilvering (fixing, bleach-fix, etc.), a stabilizing bath as a substitute for wash or a stabilizing bath for image stabilization is used frequently. Since these baths have low concentrations, the merit of preparing a granular chemical is not much, but these baths could be prepared from granules if desired. The method of reducing calcium and magnesium ions disclosed in JP-A-62-288838 is effectively applicable to the stabilizing bath. It is also effective to use bactericides or fungicides, such as isothiazolone compounds and thiabendazole compounds described in JP-A-57-8542, chlorine-containing bactericide such as chlorinated sodium isocyanurate described in JP-A-61-120145, benzotriazole compounds described in JP-A-61-267761, copper ions, and those described in Horiguchi Hiroshi, *BOKIN BOBAI NO KAGAKU*, Sankyo Shuppan (1986), Eisei Gijutsukai (ed.), *BISEIBUTSU NO GENKIN, SAKKIN, BOBAIGIJUTSU*, Kogyo Gijutsukai (1982), and Nihon Bokin Bobai Gakkai (ed.), *BOKIN BOBAIZAI JITEN* (1986).

To the stabilizing bath can be added aldehydes that deactivate any remaining magenta couplers to prevent fading or staining, such as formaldehyde, acetaldehyde, and pyruvic aldehyde; methylol compounds or hexamethylenetetramine as described in U.S. Pat. No. 4,786,583; hexahydrotriazine compounds described in JP-A-2-153348; formaldehyde/bisulfite addition compounds described in U.S. Pat. No. 4,921,779; and azolylmethylamines described in EP 504609 and EP 519190. In addition, the stabilizing bath can contain a surface active agent to improve drainage or a chelating agent, e.g., ethylenediaminetetraacetic acid, as a water softener.

[III] Processing Steps

The development processing used in the present invention basically comprises a color development step, a desilvering step, a washing or stabilizing step, and a drying step. Auxiliary steps such as a rinsing step, an intermediate washing step, and a neutralizing step can be placed between the above basic steps. Desilvering is carried out in a single step with a bleach-fixing solution or in two steps of bleaching and fixing. Washing may be replaced with processing with a stabilizing bath, or an image stabilizing bath may be placed between a stabilizing step and a drying step.

The processing may be any of a rapid processing system, a low-replenishment processing system and an international standard processing system.

For processing photosensitive materials for photographing, such as color negative films and color reversal films, the processing temperature is generally 30 to 40° C. and, for rapid processing, 38 to 65° C., preferably 40 to 55° C. The processing time is usually 1 to 8 minutes and 15 to 195 seconds, preferably 20 to 150 seconds, in rapid processing. The rate of replenishment is 600 ml per $m^2$ (of a photosensitive material to be processed) in standard development and 30 to 390 ml/$m^2$, preferably 50 to 300 ml/$m^2$, in rapid processing. A further lower rate of 80 to 200 is ml/$m^2$ also adoptable.

For processing photosensitive materials for color printing, such as color photographic papers, the processing temperature is generally 30 to 40° C. and 38 to 65° C. in rapid processing. The processing time is generally 30 seconds to 3 minutes and, for rapid processing, 5 to 45 seconds, preferably 5 to 20 seconds. The rate of replenishment is 161 ml/$m^2$ in standard processing and 10 to 150 ml/$m^2$, preferably 20 to 100 ml/$m^2$, in low-replenishment processing. A further lower rate of 25 to 80 ml/$m^2$ is possible.

In color development processing, development is followed by desilvering with a bleaching solution or a bleach-fixing solution. The bleaching time is usually 10 seconds to 6.5 minutes, preferably 10 seconds to 4.5 minutes, still preferably 15 seconds to 2 minutes. The blix time is 5 to 240 seconds, preferably 10 to 60 seconds. The processing temperature is 25 to 60° C., preferably 30 to 50° C. The rate of replenishment is 10 to 250 ml/m$^2$, preferably 10 to 100 ml/m$^2$, still preferably 15 to 60 ml/m$^2$.

After desilvering, color photographic materials are generally subjected to washing or stabilizing processing. Black-and-white photosensitive materials are generally subjected to fixing followed by washing.

The amount of water in the washing step can be selected from a broad range according to the characteristics of the photosensitive material (for example, the kinds of materials such as couplers), the use of the photosensitive material, the temperature of washing water, the number of wash tanks, and other various conditions. In particular, the relationship between the number of wash tanks and the amount of water in a multistage counter-flow system is obtained through the method described in *Journal of the Society of Motion Picture and Television Engineers*, Vol. 64, pp. 248–253 (May, 1955). The number of stages (the number of wash tanks) in a multistage counter-flow system is usually 3 to 15, preferably 3 to 10.

According to the multistage counter-flow system, the quantity of water can be diminished considerably, but because the water retention time in the tanks is so much extended, there inevitably arises the problem that bacteria grow in the tanks to stain photosensitive materials. To solve this problem, it is preferred to use a stabilizing bath containing the above-described bactericides or fungicides.

The pH of the washing water or stabilizing bath is preferably 4 to 10, still preferably 5 to 8. The temperature of the washing water or stabilizing bath is selected appropriately according to the use and characteristics of the photosensitive material but is usually in the range of from 20 to 50° C., preferably from 25 to 45° C.

The washing and/or stabilizing processing is followed by drying. Drying can be accelerated by removing the liquid from the processed photosensitive material with a squeegee roller, cloth, etc. immediately after the material is taken out of the washing or stabilizing bath so as to minimize penetration of water into the film. Drying can also be accelerated by raising the drying temperature or modifying the shape of the air nozzle to strengthen the drying air flow. The adjustment of the blowing angle and the improved ventilation method described in JP-A-3-157650 are also effective for drying acceleration.

[IV] Automatic Processor

The development processing according to the present invention is carried out by use of an automatic processor. The automatic processor that is preferably used in the invention will then be described.

The automatic processor preferably has a linear transport speed of 100 mm/sec or lower, particularly 20 to 50 mm/sec, especially 25 to 45 mm/sec.

The open area of each processing tank and each replenisher tank, namely, the liquid surface area in contact with air, is preferably as small as possible. The open area ratio, being defined as the open area (cm$^2$) divided by the liquid volume (cm$^3$), is preferably not more than 0.01 (cm$^{-1}$), still preferably not more than 0.005, particularly preferably not more than 0.001.

It is a favorable manipulation to float a solid or a liquid on the liquid surface to reduce the area in contact with air. For example, plastic floats can be floated, or a liquid that is immiscible and chemically unreactive with the processing solution, such as liquid paraffin or a liquid saturated hydrocarbon, can be spread on the processing solution or the replenisher.

A leader and a photosensitive material are preferably transported by the belt transfer system described in JP-A-60-191257, JP-A-60-191258, and JP-A-60-191259. A crossover rack structure having a plate for preventing inter-solution contamination is preferred, which is effective for shortening the tank-to-tank crossover time as well as prevention of inter-solution contamination.

Each processing solution is preferably replenished with water in an amount corresponding to the evaporation loss (evaporation correction). The evaporation correction is particularly preferred for a color developer, a bleaching solution or a bleach-fixing solution. The evaporation correction is preferably carried out with a liquid level sensor or an overflow sensor. In the most preferred evaporation correction, an estimated amount of water corresponding to an evaporation loss is added, which amount is calculated by using a coefficient obtained based on the operation time, suspension time, and temperature control time of an automatic processor as taught in Technical Disclosure Bulletin 94-49925 published by Japan Institute of Invention and Innovation.

Manipulations for diminishing the evaporation loss, such as reduction in open area or adjustment of an air flow of a ventilator, are also necessary. A preferred open area ratio of the color development tank having been described above, the open area ratio of the other processing tanks is preferably minimized likewise. In order to reduce the evaporation loss, it is preferred to keep the humidity of the space above the liquid level in a processing tank at 80% RH or higher as disclosed in JP-A-6-110171. As suggested in JP-A-6-110171, it is particularly preferred to use a processor having a cover for evaporation prevention equipped with an automatic roller cleaning mechanism (see FIGS. 1 and 2 of the publication). A ventilator is usually set in the space above a liquid level for prevention of moisture condensation during temperature control.

Drying conditions are also influential on the evaporation of processing solutions. A ceramic heater is preferably used for drying. A preferred drying air flow rate is 4 to 20 m$^3$/min, particularly 6 to 10 m$^3$/min. The thermoregulator of the ceramic heater against overheating is preferably of the type operated through heat transfer. It is preferably fitted to leeward or windward in contact with fins or a heat transfer part. The drying temperature is preferably adjusted according to the water content of the photosensitive material to be dried. The optimum drying temperature is 45 to 55° C. for APS format and 35-mm film and 55 to 65° C. for Brownie film. The drying time is preferably 5 seconds to 2 minutes, still preferably 5 to 60 seconds.

A replenishing pump is used for processing solution replenishment. A bellows pump is preferred. The tube feeding the replenisher to a replenishing nozzle can be narrowed to prevent a back flow when the pump is at rest, which is effective for improving the accuracy of replenishment.

While the processing steps have been described with reference to continuous processing with replenishment, the present invention is applicable as well to batch system processing in which development and following processing steps are conducted with a given amount of each processing solution without replenishment, and the whole or part of each processing solution is changed for a fresh one occasionally.

In preparing a processing solution from a pre-packaged chemical, a one-package formulation which contains all the components of a working solution is advantageously used. Where it is undesirable for some components of a color development chemical, a bleach-fix chemical, etc. to be in contact with each other for a long period of time, the formulation can be divided into two or three liquid and/or solid packages. These formulations are called one-, two- or three-part formulations according to ISO 5989. The effects and features of the prepared chemical used in the present invention are not impaired by dividing into parts. A one-part formulation is preferred for a color developer.

Containers of the processing solutions can be made of known materials of choice according to the contents. Containers can be made of a single material or a composite material composed of, for example, a highly gas-permeable material and a highly alkali-stable material. From the standpoint of reusability or recyclability, containers made of a single material are preferred. Materials useful for the containers include polyesters, polyolefins such as polyethylene, acrylic resins, ABS resins, epoxy resins, polyamides such as nylon, polyurethane, polystyrene, polycarbonate, polyvinyl alcohol, polyvinyl chloride, and polyvinylidene chloride. Containers made of one of polyesters, such as polyethylene terephthalate and polyethylene naphthalate, or polyolefins, such as polyethylene and polypropylene, are preferred. Containers made of a polyethylene resin, particularly high-density polyethylene, are still preferred.

The resins making the containers can contain pigments such as carbon black and titanium dioxide, fillers such as calcium carbonate, and compatible plasticizers. Preferred materials for making the containers are polyethylene resin compositions having a polyethylene content of 85% or more, particularly 95% or more, and containing no plasticizers.

The shape and structure of the containers are arbitrarily designed according to the use. Specially designed containers, such as the stretchable container disclosed in JP-A-1-235950, the stretchable container having flexible diaphragms disclosed in JP-A-62-134626, and the container disclosed in JP-A-11-282148, can be used as well as standard bottles. The containers of JP-A-11-282148 are particularly advantageous for their capacity, space saving, stability, shape retention, and reusability or recyclability. A packaged kit having a plurality of prepared chemicals in the respective containers of a shape, a capacity and a material, the containers being packed in a single package, is preferred. The cartridge disclosed in JP-A-12-3014 is an example of such a kit. The combination of the plurality of prepared chemicals is of choice. The cartridge described in JP-A-11-295858 and JP-A-11-288068 presents a preferred embodiment in which a developer composition, a bleaching composition and a fixing composition are combined.

[V] Photosensitive Materials

The photosensitive materials to which the processing solution of the present invention is applicable include color photosensitive materials for photographing, color photographic printing papers, and black-and-white photosensitive materials for photographing. These photosensitive materials have at least one photosensitive layer on a support. A typical example of the photosensitive materials is silver halide photographic materials comprising a support having thereon at least one photosensitive layer composed of a plurality of silver halide emulsion layers which have the same color sensitivity but different photographic speeds. It is photo sensitive materials for color printing that particularly enjoys the effects of the present invention.

In multilayer silver halide color photographic materials for photographing, each photosensitive layer (unit photosensitive layer) has sensitivity to any one of blue light, green light and red light. Unit photosensitive layers are generally provided in the order of a red-sensitive layer, a green-sensitive layer, and a blue-sensitive layer from the support. According to the purpose, this order of layers can be reversed, or two layers having the same color sensitivity can have a photosensitive layer having different color sensitivity sandwitched therebetween. A light-insensitive layer can be provided between silver halide photosensitive layers or as a top layer or a bottom layer. These layers may contain couplers, DIR compounds, color mixture preventives, and the like. Each unit photosensitive layer preferably has a two-layer structure composed of a high-speed emulsion layer and a low-speed emulsion layer, which are provided in order of descending sensitivity toward the support, as described in DE 1,121,470 and GB 923,045. It is also possible to provide a low-speed emulsion layer farther from the support, and a high-speed emulsion layer nearer to the support, as described in JP-A-57-112751, JP-A-62-200350, JP-A-62-206541, and JP-A-62-206543.

Examples of layer orders include an order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), an order of BH/BL/GL/GH/RH/RL, and an order of BH/BL/GH/GL/RL/RH, each from the side farthest from the support. A layer order of blue-sensitive layer/GH/RH/GL/RL from the side farthest from the support as described in JP-B-55-34932 and a layer order of blue-sensitive layer/GL/RL/GH/RH from the side farthest from the support as described in JP-A-56-25738 and JP-A-62-63936 are also employable.

Further, a unit photosensitive layer may be composed of three layers whose sensitivity varies in a descending order toward the support, i.e., the highest-speed emulsion layer as the upper layer, a middle-speed emulsion layer as an intermediate layer, and the lowest-speed emulsion layer as the lower layer, as proposed in JP-B-49-15495. Three layers of different sensitivity in each unit may also be arranged in the order of middle-speed emulsion layer/high-speed emulsion layer/low-speed emulsion layer from the side farther from the support as described in JP-A-59-202464. Furthermore, an order of high-speed emulsion layer/low-speed emulsion layer/middle-speed emulsion layer or an order of low-speed emulsion layer/middle-speed emulsion layer/high-speed emulsion layer are also useful. In the case of multilayer structures composed of four or more unit photosensitive layers, the order of silver halide emulsion layers may be altered similarly.

An interlayer effect-donating layer (CL) which has a different spectral sensitivity distribution from a main photosensitive layer (BL, GL or RL) is preferably provided next or close to the main photosensitive layer for the purpose of improving color reproducibility as described in U.S. Pat. Nos. 4,663,271, 4,705,744 and 4,707,436, JP-A-62-160448, and JP-A-63-89850.

Silver halides which can be preferably used in the photographing materials are silver iodobromide, silver iodochloride and silver iodochlorobromide having a silver iodide content of not more than about 30 mol %. Silver iodobromide or silver iodochlorobromide having a silver iodide content of about 2 to 10 mol % is still preferred.

Silver halide emulsion grains in the photographic emulsions include those having a regular crystal shape, such as a cubic shape, an octahedral shape or a tetradecahedral shape; those having an irregular crystal shape, such as a spherical shape and a tabular shape; those having a crystal defect such as twin planes; and those having a composite shape of these crystal shapes. Silver halide grains can have a broad range of size fit for the respective photosensitive layers, including from fine grains of 0.1 to 0.2 μm to large grains of 1.0 to 10 μm in terms of a projected area diameter. The emulsions may be either a polydispersion or a monodispersion.

It is preferable to use light-insensitive fine silver halide grains in the color photosensitive materials. The "light-insensitive fine silver halide grains" are fine silver halide grains which are insensitive to imagewise exposure for color image formation and therefore undergo substantially no development in the subsequent development processing. It is preferable for the light-insensitive fine silver halide grains not to be fogged previously. The fine silver halide grains have a silver bromide content of from 0 up to 100 mol % and, if necessary, may contain silver chloride and/or silver iodide, preferably having a silver iodide content of 0.5 to 10 mol %. The fine silver halide grains preferably have an average grain size (an average projected area circle-equivalent diameter) of 0.01 to 0.5 μm, still preferably 0.02 to 0.2 μm. The fine silver halide grains can be prepared in the same manner as for general photosensitive silver halide grains. The surface of the fine silver halide grains needs neither optical sensitization nor spectral sensitization. It is preferable to add known stabilizers, such as triazole compounds, azaindene compounds, benzothiazolium compounds, mercapto compounds, and zinc compounds, to the fine silver halide grains prior to addition to a coating composition. Colloidal silver maybe incorporated into the layer containing the fine silver halide grains.

The silver coating weight of the color photosensitive materials is preferably 6.0 g/m$^2$ or less, still preferably 4.5 g/m$^2$ or less.

In the color photosensitive materials, the hydrophilic colloidal layers on the photosensitive emulsion side preferably have a total film thickness of 28 μm or smaller, still preferably 23 μm or/less, yet preferably 18 μm or smaller, and particularly preferably 16 μm or smaller. The photosensitive material preferably has a rate of swelling $T_{1/2}$ of not more than 30 seconds, still preferably 20 seconds or less. The terminology "rate of swelling $T_{1/2}$ " means a time required for a photosensitive material to be swollen to half the saturated swollen film thickness, the saturated swollen film thickness being defined to be 90% of the maximum swollen film thickness which is reached when the photosensitive material is processed in a color developer at 30° C. for 3 minutes and 15 seconds. The terminology "film thickness" as used here in means a film thickness as measured after conditioning at 25° C. and a relative humidity of 55% for 2 days. The rate of swelling $T_{1/2}$ can be measured with a swellometer of the type described in A. Green, et al., *Photographic Science and Engineering*, vol. 19, No. 2, pp. 124–129. $T_{1/2}$ can be adjusted by adding a proper amount of a hardener for a gelatin binder or by varying aging conditions after coating. Further, the color photosensitive material preferably has a degree of swelling of from 150 to 400%. The terminology "degree of swelling" as used herein means a value obtained from the maximum swollen film thickness as defined above according to formula: (maximum swollen film thickness—film thickness)/film thickness.

On the other hand, silver halide grains in photographic emulsions used for printing include those having a regular crystal form, such as a cubic form, an octahedral form or a tetradecahedral form; those having an irregular crystal form, such as a spherical form and a tabular form; and those having a composite form of these crystal forms.

Photographic emulsions containing tabular grains having a {111} face or a {100} face as main planes (the pair of parallel planes perpendicular to the grain thickness direction) are preferably used. Processes using various crystal habit controlling agents for forming {111} tabular grains are known. For example, the compounds described in JP-A-2-32 (compound Nos. 1 to 42) are preferred crystal habit controlling agents.

The silver halide grains used in the photosensitive materials for photographic printing paper are preferably high silver chloride grains having a silver chloride content of 95 mol % or higher (the term "high silver chloride grains" is used to denote silver halide grains having a silver chloride content of 80 mol % or higher). The high silver chloride grains preferably have a core/shell structure. The core preferably has a silver chloride content of 90 mol % or higher. The core may be composed of two or more parts having different halogen compositions. The volume ratio of the shell in individual grains is preferably not more than 50%, particularly 20% or smaller. The shell is preferably made of silver iodochloride or silver iodobromochloride, which preferably has an iodine content of 0.5 to 13 mol %, particularly 1 to 13 mol %. A preferred total silver iodide content in individual grains is not more than 5 mol %, particularly 1 mol % or less. The silver bromide content is preferably higher in the shell than in the core. A preferred silver bromide content is not more than 20 mol %, particularly 5 mol % or less.

The average grain size of the silver halide grains used in the photosensitive material for photographic printing paper is not particularly limited but is preferably 0.1 to 0.8 μm, still preferably 0.1 to 0.6 μm, in terms of a sphere-equivalent diameter. A preferred circle-equivalent diameter of tabular grains is 0.2 to 1.0 μm. The term "diameter" as used for silver halide grains denotes the diameter of a circle equal in area to a projected area of a grain in an electron micrograph. The tabular grains have a thickness of 0.2 μm or smaller, preferably 0.15 μm or smaller, still preferably 0.12 μm or smaller. The grain size distribution of silver halide grains may be either polydispersed or monodispersed but is preferably monodispersed. It is particularly preferred that tabular grains which constitute 50% or more of the total projected area have a circle-equivalent diameter variation coefficient of 20% or smaller, ideally 0%.

The following description applies to both the photosensitive materials for photographing and for printing. The silver halide photographic emulsions to be used in the present invention can be prepared by known techniques described, e.g., in Research Disclosure (hereinafter abbreviated as RD), No. 17643, pp. 22–23, "I. Emulsion preparation and types" (December, 1978), *ibid.*, No. 18716, p. 648 (November 1979), *ibid.*, No. 307105, pp. 863–865 (November 1989), P. Glafkides, *Chemie et Phisique Photographique*, Paul Montel (1967), G. F. Duffin, *Photographic Emulsion Chemistry*, Focal Press (1966), and V. L. Zelikman, et al., *Making and Coating Photographic Emulsion*, Focal Press (1964).

The monodispersed emulsions described in U.S. Pat. Nos. 3,574,628 and 3,655,394 and British Patent 1,413,748 are also preferred.

Tabular grains having an aspect ratio of about 3 or more are useful in the present invention. The tabular grains can easily be prepared by known processes described, e.g., in Gutoff, *Photographic Science and Engineering*, vol. 14, pp. 248–257 (1970), U.S. Pat. Nos. 4,434,226, 4,414,310, 4.433,048, and 4,439,520, and British Patent 2,112,157.

The silver halide grains may have a homogeneous crystal structure, or may have a heterogeneous structure in which the inside and the outside have different halogen compositions, or may have a layered structure. Silver halides of different composition may be fused by epitaxy. Compounds other than silver halides, such as silver thiocyanate or lead oxide, may be fused to silver halide grains. Further, a mixture of various grains having different crystal forms may be used.

The emulsions may be any of a surface latent image type which forms a latent image predominantly on the surface of the grains, an internal latent image type which forms a latent image predominantly in the inside of the grains, and a type which forms a latent image both on the surface and in the inside. Anyway, the emulsion must be of negative type. The internal latent image type emulsion may be a core/shell type emulsion as described in JP-A-63-264740. A process for preparing a core/shell type internal latent image type emulsion is described in JP-A-59-133542. The shell thickness is preferably 3 to 40 nm, still preferably 5 to 20 nm, while varying depending on development processing, etc.

The silver halide emulsions are usually used after being subjected to physical ripening, chemical ripening, and spectral sensitization. Additives used in these steps are described in RD Nos. 17643, 18716, and 307105 as tabulated below.

A mixture of two or more emulsions different in at least one of grain size, grain size distribution, halogen composition, grain shape, and sensitivity may be used in the same layer. Surface-fogged silver halide grains described in U.S. Pat. No. 4,082,553, internal-fogged silver halide grains described in U.S. Pat. No. 4,626,498 and JP-A-59-214852, and colloidal silver are preferably used in photosensitive silver halide emulsion layers and/or substantially light-insensitive hydrophilic colloid layers. The terminology "surface- or internal-fogged silver halide grains" as used herein means silver halide grains which are developable uniformly (i.e., non-imagewise) independently of exposure. Methods for preparing these fogged grains are described in U.S. Pat. No. 4,626,498 and JP-A-59-214852. The silver halide which forms the fogged core of the internal-fogged core/shell type grains may be different from the outer shell in halogen composition. Internal- or surface-fogged silver halide grains may be any of silver chloride grains, silver chlorobromide grains, silver iodobromide grains, and silver chloroiodobromide grains.

Photographic additives which can be used in the color photosensitive materials are also described in RD Nos. 17643, 18716, and 307105 as listed below. In the list, "RC" and "LC" stand for right column and left column, respectively.

| Additive | RD 17643 | RD 18716 | RD 307105 |
|---|---|---|---|
| Chemical sensitizer | p. 23 | p. 648, RC | p. 866 |
| Speed increasing agent | | p. 648, RC | |
| Spectral sensitizer and supersensitizer | pp. 23–24 | p. 648, RC to p. 649, RC | pp. 866–868 |
| Brightening agent | p. 24 | p. 647, RC | p. 868 |
| Light absorber, filter dye and UV absorber | pp. 25–26 | p. 649, RC to P. 650, LC | p. 873 |
| Binder | p. 26 | p. 651, LC | pp. 873–874 |
| Plasticizer and lubricant | p. 27 | p. 650, RC | p. 876 |
| coating aid and surface active agent | pp. 26–27 | p. 650, RC | pp. 875–876 |
| Antistatic agent | p. 27 | p. 650, RC | pp. 876–877 |
| Matting agent | | | pp. 878–879 |

While various color forming couplers can be used in the color photosensitive materials, the following couplers are particularly preferred.

Yellow Couplers

Couplers represented by formulae (I) and (II) of EP 502424A, couplers represented by formulae (1) and (2) of EP 513496A (especially Y-28 on page 18), couplers represented by formula (I) claimed in claim 1 of EP 568037A, couplers represented by formula (I) of U.S. Pat. No. 5,066, 576, col. 1, 11. 45–55, couplers represented by formula (I) of JP-A-4-274425, para. 0008, couplers claimed in claim 1 of EP49838 1A1 (especially D-35 on page 18), couplers represented by formula (Y) of EP 447969A1, page 4 (especially Y-1 on page 17 and Y-54 on page 41), and couplers represented by formulae (II) to (IV) of U.S. Pat. No. 4,476,219, col. 7, 11. 36–58 (especially II-17 and II-19 in col. 17 and II-24 in col. 19).

Magenta Coupler

L-57, L-68, and L-77 of JP-A-3-39737, pp. 11–13; A-4-63, A-4-73 and A-4-75 of EP 456257, pp. 134 and 139; M-4, M-6, and M-7 of EP 486965, pp. 26–27; M-45 of EP 571959A, p. 19; M-1 of JP-A-5-204106, p. 6; and M-22 of JP-A-4-362631, para. 0237.

Cyan Coupler

CX-1, 3, 4, 5, 11, 12, 14, and 15 of JP-A-4-204843, pp. 14–16; C-7, C-10, C-34, C-35 (pp. 35 and 37), (I-1) and (I-17) (pp. 42 and 43) of JP-A-4-43345; and couplers represented by formulae (Ia) or (Ib) claimed in claim 1 of JP-A-6-67385.

Polymer Coupler

P-1 and P-5 of JP-A-2-44345, p. 11.

Examples of suitable couplers which form a dye having moderate diffusibility are described in U.S. Pat. No. 4,366, 237, British Patent 2,125,570, EP 96,873B, and DE 3,234, 533.

Examples of suitable colored couplers for correcting unnecessary absorption of a developed dye are yellow-colored cyan couplers represented by formulae (CI), (CII), (CIII), and (CIV) described in EP 456257A1, p. 5 (especially YC-86 on p. 84); yellow-colored magenta couplers ExM-7, EX-1, and EX-7 of EP 456257A1, pp. 202, 249 and 251; magenta-colored cyan couplers CC-9 and C-13 of U.S. Pat. No. 4,833,069, cols. 8 and 10; coupler (2) of U.S. Pat. No. 4,837,136, col. 8; and colorless masking couplers represented by formula (A) claimed in claim 1 of WO 92/11575 (especially the compounds on pp. 36–45).

Compounds capable of releasing a photographically useful residue include development inhibitor-releasing compounds represented by formulae (I) to (IV) of EP 378236A1, p. 11; bleaching accelerator-releasing compounds represented by formulae (I) and (I) of EP 310125A2, p. 5; ligand-releasing compounds represented by formula LIG-X claimed in claim 1 of U.S. Pat. No. 4,555,478; leuco dye-releasing compounds (compounds 1 to 6) of U.S. Pat. No. 4,749,641, cols. 3–8; fluorescent dye-releasing compounds described in claim 1 of U.S. Pat. No. 4,774,181; development accelerator- or fogging agent-releasing compounds represented by formulae (1) to (3) of U.S. Pat. No. 4,656,123, col. 3; and compounds releasing a group which becomes a dye on release represented by formula (I) described in claim 1 of U.S. Pat. No. 4,857,447.

Additives other than couplers which can be used in the color photosensitive materials include dispersing media for oil-soluble organic compounds, loadable latices for oil-soluble organic compounds, scavengers for an oxidized developing agent, stain inhibitors, discoloration preventives, hardeners, development inhibitor precursors, stabilizers, antifoggants, chemical sensitizers, dyes, dye crystallite dispersions, and UV absorbers.

The present invention can be applied to processing of various color photographic materials including color negative films for general use or for motion pictures, color reversal films for slides or TV, color photographic papers, and color positive films. The present invention is also suited to film units with a lens described in JP-B-2-32615 and JP-A-U-3-39784.

Examples of the supports which can be suitably used in the color photographic materials processed by the present invention are described, e.g., in RD, No. 17643, p. 28, ibid., No. 18716, p. 647, right column to p. 648, left column, and ibid., No. 307105, p. 879.

It is preferred for the color photographic materials to have a hydrophilic colloidal layer(s) called a backing layer having a total dry thickness of from 2 to 20 $\mu$m on the side opposite to the photosensitive emulsion layer side. The backing layer preferably contains the above-described additives, such as light absorbers, filter dyes, ultraviolet absorbers, antistatic agents, hardeners, binders, plasticizers, lubricants, coating aids, and surface active agents. The backing layer preferably has a degree of swelling of from 150 to 500%.

The color photographic materials to which the invention is applied often have a magnetic recording layer, which is formed by coating a support with an aqueous or organic solvent coating composition prepared by dispersing magnetic powder in a binder resin.

A reflective support is used in color photographic printing paper. Preferred reflective supports are paper substrates laminated with a plurality of water-resistant resin layers such as polyethylene layers and polyester layers, at least one of the resin layers containing a white pigment, such as titanium dioxide.

It is preferred for the water-resistant resin layers to contain a fluorescent whitening agent. A fluorescent whitening agent can also be dispersed in the hydrophilic colloidal layer of the photosensitive material. Examples of preferred fluorescent whitening agents include benzoxazole compounds, coumarin compounds, and pyrazoline compounds. Benzoxazolylnaphthalene compounds and benzoxazolylstilbene compounds are particularly preferred. While not limiting, the fluorescent whitening agent is preferably used in an amount of 1 to 100 mg/m$^2$. Where used as mixed into the water-resistant resin, the fluorescent whitening agent is preferably added in an amount of 0.0005 to 3%, particularly 0.001 to 0.5%, by weight based on the resin.

The support may be a transmitting support or a support composed of the above-described reflective support and a hydrophilic colloid layer containing a white pigment. The reflective support may be one having a metallic surface with specular reflection or the second kind diffuse reflection.

The support of color photosensitive materials for photographing includes a cellulose triacetate film and a polyester film. For the details, refer to Technical Disclosure Bulletin 94-6023 published by Japan Institute of Invention and Innovation. Polyesters suitable as a support are those prepared from a diol and an aromatic dicarboxylic acid as essential components. The aromatic dicarboxylic acids include 2,6-, 1,5-, 1,4-or 2,7-naphthalenedicarboxylic acid, terephthalic acid, isophthalic acid, and phthalic acid, and the diol includes diethylene glycol, triethylene glycol, cyclohexanedimethanol, bisphenol A, and bisphenol. Such polyesters include polyethylene terephthalate, polyethylene naphthalate, and polycyclohexanedimethanol terephthalate. Polyesters having a 2,6-naphthalenedicarboxylic acid component in a proportion of 50 to 100 mol % based on the total dicarboxylic acid component are preferred. Polyethylene 2,6-naphthalenedicarboxylate is particularly preferred. The polyesters preferably have an average molecular weight of about 5,000 to 200,000 and a glass transition point of 50° C. or higher, particularly 90° C. or higher.

UV absorbers can be incorporated into the polyester film support. For preventing light piping, a commercially available dye or pigment for polyesters, such as Diaresin from Mitubishi Chemical Industries, Ltd. and Kayaset from Nippon Kayaku Co., Ltd., can be incorporated into the polyester.

In order to improve adhesion between the support and layers constituting a photosensitive material, the support is preferably subjected to a surface activating treatment either directly or via a subbing layer. Surface activating treatments include a chemical treatment, a mechanical treatment, a corona discharge treatment, a flame treatment, an ultraviolet treatment, a radio frequency treatment, a glow discharge treatment, an active plasma treatment, a laser treatment, a mixed acid treatment, and an ozone treatment. An ultraviolet treatment, a flame treatment, a corona discharge treatment or a glow discharge treatment is preferred.

It is preferred for the color photographic materials applied to the present invention to contain antistatic agents. Useful antistatic agents include polymers having a carboxyl group or a salt thereof or a sulfonate group, cationic polymers, and ionic surface active agents. Particularly suitable antistatic agents are conductive fine particles or colloidal fine particles (sol) of at least one conductive crystalline metal oxide selected from zinc oxide, silicon dioxide, titanium dioxide, alumina, indium oxide, magnesium oxide, barium oxide, manganese oxide, and vanadium oxide or a complex oxide of the above metals (e.g., with Sb, P, B, In, S, Si, and C) which have a volume resistivity of not more than $10^7$ Ω·cm, particularly $10^5$ Ω·cm or lower, and a particle size of 0.001 to 1.0 $\mu$m. The antistatic agent is preferably used in an amount of 5 to 500 mg/m$^2$, still preferably 10 to 350 mg/m$^2$. A weight ratio of the conductive crystalline oxide or complex oxide to the binder is preferably 1/300 to 100/1, still preferably 1/100 to 100/5.

The color photographic materials are preferably endowed with slip properties. For this purpose, a lubricant-containing layer is preferably provided on both the photosensitive layer side and the back side. Suitable slip properties are such that the coefficient of dynamic friction ranges from 0.01 to 0.25 as measured by sliding a sample film on stainless steel balls of 5 mm in diameter at a speed of 60 cm/min at 25° C. and 60% RH. The results obtained by this measurement substantially agree with those obtained with the photosensitive layer surface in place of the stainless steel balls. Useful lubricants include organopolysiloxanes, higher fatty acid amides, higher fatty acid metal salts, and esters of higher fatty acids and higher alcohols. Examples of the organopolysiloxanes are dimethyl polysiloxane, diethylpolysiloxane, styrylmethylpolysiloxane, and methylphenyl polysiloxane. The lubricants are preferably added to the top layer on the emulsion layer side and a backing layer. Dimethyl polysiloxane or esters having a long-chain alkyl group are particularly preferred as a lubricant.

The color photographic materials preferably contain a matting agent on either the emulsion layer side or the back side, preferably in the top layer of the emulsion layer side. Matting agents used may be either soluble or insoluble in processing solutions. It is preferable to use both in combination. For example, particles of polymethylmethacrylate, a methyl methacrylate/methacrylic acid copolymer (9/1 or 5/5 by mole) or polystyrene are preferred. A preferred particle size of the matting agent is 0.8 to 10 $\mu$m. The particles preferably have such a narrow size distribution that 90% or more of the number of all the particles have their particle diameter falling within a range of from 90 to 110% of the mean particle diameter. In order to increase the matte effect, it is also preferable to add particles finer than 0.8 $\mu$m in combination. Examples of such finer particles are polymethyl methacrylate fine particles of 0.2 μm, methyl methacrylate/methacrylic acid copolymer particles (9/1 by mole) of 0.3 μm, polystyrene resin particles of 0.25 μm, and colloidal silica of 0.03 μm.

While the photographic materials to which the present invention is applied have been described with particular reference to color photographic materials, the foregoing also applies when the present invention is applied to processing of positive black-and-white photosensitive materials for photographing or for printing, except for the description concerning color development.

General-purpose printers are used to obtain prints. The photographic materials contemplated in the present invention are applicable to not only a printing system using an ordinary negative printer but a scanning exposure system using a cathode ray tube (CRT). CRT printers are more convenient, compact, economical and advantageous for optical axis and color control than laser printers. CRTs for image exposure use various light-emitting materials which emit light in the spectral region as required. For example, at least one of a red-emitting material, a green-emitting material and a blue-emitting material is used. The spectral region is not limited to red, green or blue, and phosphors emitting light in the yellow, orange, purple or infrared region are also used. CRTs using a mixture of these emitters to produce white light are often used.

Where a photosensitive material has a plurality of photosensitive layers different in spectral sensitivity, and a CRT has a mixed phosphor emitting light in a plurality of spectral regions, the plurality of colors can be exposed at a time, i.e., image signals of the plurality of colors can be input into the CRT to cause light emission from the tube surface. Alternatively, the photosensitive material can be exposed to monochromatic light according to image signals for each color through filters cutting the other colors (successive planar exposure). Successive planar exposure is generally preferred for high image quality because CRTs having high resolution are employable.

A digital scanning exposure system is also preferred, which uses monochromatic high-density light from a gas laser, a light-emitting diode, a semiconductor laser or a second harmonic generation (SHG) light source composed of non-linear optical crystals and a semiconductor laser or a solid state laser having a semiconductor laser as an exciting light source. A semiconductor laser or an SHG light source composed of a non-linear optical crystal and a semiconductor laser or a solid state laser is preferred for making the system compact and inexpensive. A semiconductor laser is particularly advantageous for designing a compact, inexpensive, durable and stable system. It is advisable to use a semiconductor laser as at least one of exposure light sources.

In using such a scanning exposure light source, the spectral sensitivity maximum of the photosensitive material to be processed can be set according to the wavelength of the light source used. Since an SHG light source composed of a solid state laser using a semiconductor laser as an exciting light source or a semiconductor laser combined with a nonlinear optical crystal splits the oscillation wavelength of a laser into halves, blue light and green light are obtained. Therefore, a photosensitive material can be designed to have spectral sensitivity maxima in usual blue, green and red regions. The exposure time in scanning exposure, being defined as a time for exposing a pixel size having a pixel density of 400 dpi, is preferably $10^{-4}$ second or shorter, still preferably $10^{-6}$ second or shorter.

It is possible to give a latent image of microdot pattern to a photosensitive material so as to prevent unauthorized copying of prints. The details of this technique are given in JP-A-9-226227.

For the details of preferred scanning exposure systems, reference can be made in the patents listed above.

Additionally, the processing elements and methods described in JP-A-2-207250, page 26, lower right column, line 1 to page 34, upper right column, line 9 and JP-A-4-97355, page 5, upper left column, line 17 to page 18, lower right column, line 20 are applied to advantage.

The present invention will now be illustrated in greater detail with reference to Examples, but it should be understood that the invention is not limited thereto. Unless otherwise noted, all the percents are by weight.

EXAMPLE 1

1) Preparation of Silver Halide Color Photographic Material (sample 001)

Preparation of Emulsion A

To 1.06 liter of deionized distilled water containing 5.7% deionized gelatin were successively added 46.3 ml of a 10% sodium chloride aqueous solution, 46.4 ml of 1N sulfuric acid, and 0.012 g of compound A shown below. The mixture was heated to 50° C., and immediately thereafter 0.1 mol of silver nitrate and 0.1 mol of sodium chloride were added simultaneously to the mixture over 10 minutes while stirring at a high speed. Then, 1.5 mol of silver nitrate and an aqueous sodium chloride solution were added simultaneously over 60 minutes at an increasing rate of addition such that the final rate was four times the initial one. Silver nitrate (0.2 mol) and a sodium chloride aqueous solution were further added simultaneously at a constant rate over 6 minutes. The sodium chloride solution added in this stage contained $5\times10^{-7}$ mol of $K_3IrCl_5.H_2O$ per mole of total silver to dope the silver halide grains with iridium.

Finally, 0.2 mol of silver nitrate and an aqueous solution of 0.16 mol of sodium chloride and 0.04 mol of potassium bromide were added simultaneously over 6 minutes. The halide solution added here contained $1\times10^{-5}$ mol of $K_4Ru(CN)_6$ per mole of total silver for ruthenium doping. In this final grain growth stage, when grain formation reached 93% of completion, an aqueous solution of 0.04 mol, per mole of total silver, of potassium iodide was added over 1 minute. Compound B shown below was added as a flocculant at 40° C., and the pH was adjusted to around 3.5 to conduct desalting, followed by washing with water.

To the desalted and washed emulsion were added deionized gelatin, an aqueous sodium chloride solution, and an aqueous sodium hydroxide solution, the temperature was raised to 50° C., and the emulsion was adjusted to a pAg of 7.6 and a pH of 5.6. The resulting emulsion contained cubic grains consisting of 97.8 mol % of silver chloride, 2 mol % of silver bromide and 0.2 mol % of silver iodide and having an average side length of 0.41 μm with a coefficient of side length variation of 8%, which was used as a smaller size emulsion of emulsion A. A larger size emulsion of emulsion A and all the other photographic emulsions were prepared in accordance with the above procedure.

The emulsion was kept at 50° C., and $3\times10^{-4}$ mol/mol-Ag of sensitizing dye 1 and $3\times10^{-5}$ mol/mol-Ag of sensitizing dye 2, both shown below, were added for spectral sensitization. To the emulsion were further added $1\times10^{-5}$ mol/mol-Ag of thiosulfonic acid compound 1 shown below and an emulsion of fine grains having an average grain size of 0.05 μm, a silver bromide content of 90 mol %, and a silver chloride content of 10 mol % and doped with iridium hexachloride, and the emulsion was left to stand for 15 minutes for ripening. By this ripening the fine grains dissolved to have the host grains grow to increase its silver bromide content to 2.7 mol % and doped with $1\times10^{-7}$ mol/mol-Ag of iridium hexachloride. Subsequently, the emulsion was chemically ripened by adding $1\times10^{-5}$ mol/mol-Ag of sodium thiosulfate and $2\times10^{-5}$ mol/mol-Ag of a gold sensitizer 1 shown below, immediately elevating the temperature to 60° C., and allowing the emulsion to stand for 40 minutes. Immediately after cooling to 50° C., mercapto compounds 1 and 2 shown below were added in an amount of $6\times10^{-4}$ mol/mol-Ag each, followed by ripening for 10 minutes. An aqueous potassium bromide solution was then added in an amount of 0.008 mol/mol-Ag, followed by ripening for 10 minutes, and cooled.

Compound A:

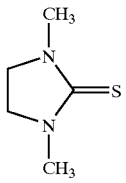

Compound B:

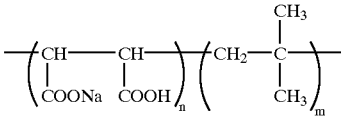

(n, m: integer)

Sensitizing dye 1:

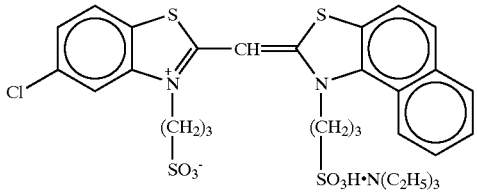

Sensitizing dye 2:

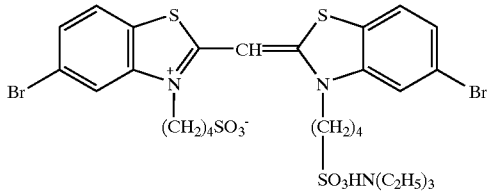

Mercapto compound 1:

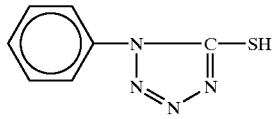

Mercapto compound 2:

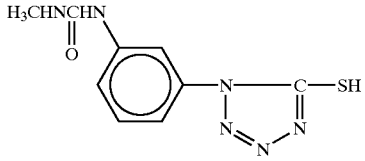

-continued

Thiosulfonic acid compound 1:

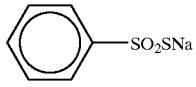

Gold sensitizer 1:

1:1 (by mole) mixture of chloroauric acid and

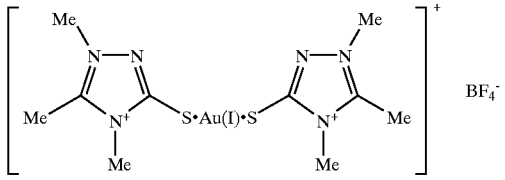

A paper support laminated with polyethylene on both sides thereof was subjected to a corona discharge treatment. A gelatin subbing layer containing sodium dodecylbenzenesulfonate was provided thereon, and various photographic layers were further provided thereon to prepare a multilayer color paper, designated sample 001. Coating compositions were prepared as follows. Preparation of coating composition for 1st layer:

Yellow coupler ExY (57 g), dye image stabilizer Cpd-1 (7 g), dye image stabilizer Cpd-2 (4 g), dye image stabilizer Cpd-3 (7 g), and dye image stabilizer Cpd-8 (2 g) were dissolved in a mixture of solvent Solv-1 (21 g) and ethylacetate (180 ml). The resulting solution was emulsified and dispersed in 220 g of a 23.5% aqueous gelatin solution containing 4 g of sodium dodecylbenzenesulfonate in a high-speed emulsifier (Dissolver) to prepare emulsified dispersion A (900 g).

Emulsified dispersion A and emulsion A were mixed and dissolved to prepare a coating composition for a first layer having the composition described below.

Coating compositions for the other emulsion layers were prepared in the same manner as described above. Each of the 1st to 7th layers contained gelatin hardeners H-1 (sodium 1-hydroxy-3,5-dichloro-s-triazine), H-2 and H-4 shown below. Further, all the layers contained antiseptics Ab-1, Ab-2, Ab-3, and Ab-4 shown below in a total amount of 15.0 mg/m$^2$, 60.0 mg/m$^2$, 5.0 mg/m$^2$, and 10.0 mg/m$^2$, respectively.

Hardener H-1:

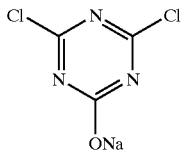

(added in an amount of 1.4% based on gelatin)

Hardener H-2:

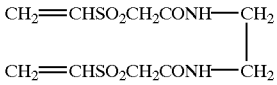

-continued

Hardener H-3:

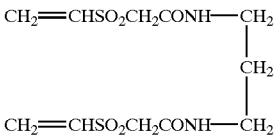

Antiseptic Ab-1:

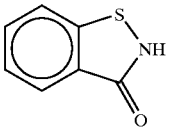

Antiseptic Ab-2:

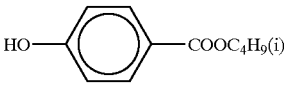

Antiseptic Ab-3:

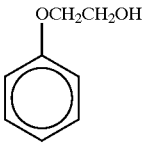

-continued

Antiseptic Ab-4:

1:1:1:1 (by mole) mixture of compounds a, b, c, and d

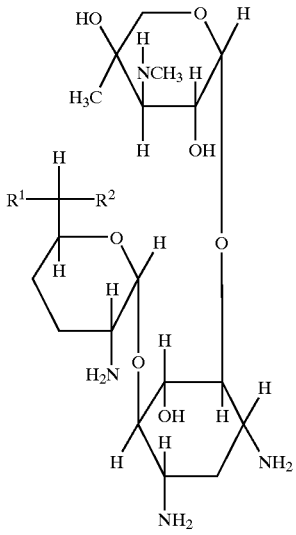

| | $R^1$ | $R^2$ |
|---|---|---|
| a | $CH_3$ | $NHCH_3$ |
| b | $CH_3$ | $NH_2$ |
| c | H | $NH_2$ |
| d | H | $NHCH_3$ |

For preparation of a green-sensitive emulsion layer, spectral sensitizing dyes D, E and F shown below were used. Sensitizing dye D was added to a larger size emulsion in an amount of $3.0\times10^{-4}$ mol/mol-AgX (silver halide) and to a smaller size emulsion in an amount of $3.6\times10^{-4}$ mol/mol-AgX. Sensitizing dye E was added to a larger size emulsion in an amount of $4.0\times10^{-5}$ mol/mol-AgX and to a smaller size emulsion in an amount of $7.10\times10^{-5}$ mol/mol-AgX. Sensitizing dye F was added to a larger size emulsion in an amount of $2.0\times10^{-4}$ mol/mol-AgX and to a smaller size emulsion in an amount of $2.8\times10^{-4}$ mol/mol-AGX.

Sensitizing dye D:

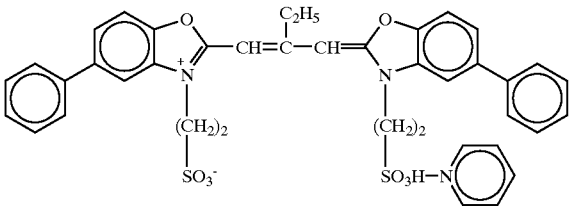

Sensitizing dye E:

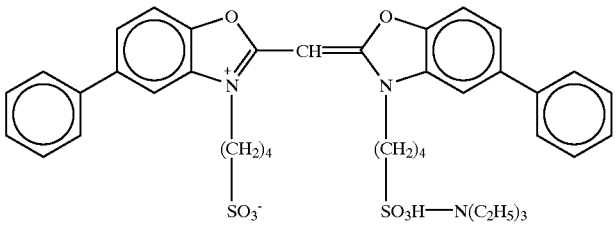

-continued

Sensitizing dye F:

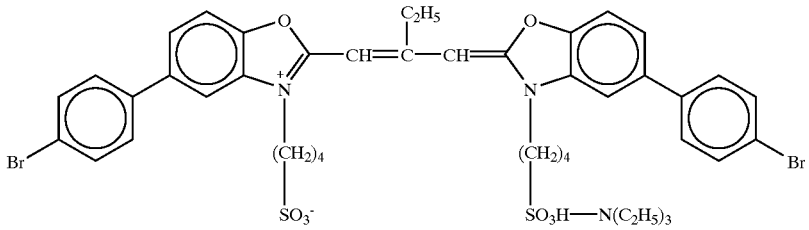

For preparation of a red-sensitive emulsion layer, sensitizing dyes 1 and 2 were replaced with spectral sensitizing dyes G and H shown below. Sensitizing dyes G and H were each added to a larger size emulsion in an amount of $8.0\times10^{-5}$ mol/mol-AgX and to a smaller size emulsion in an amount of $10.7\times10^{-5}$ mol/mol-AgX.

Sensitizing dye G:

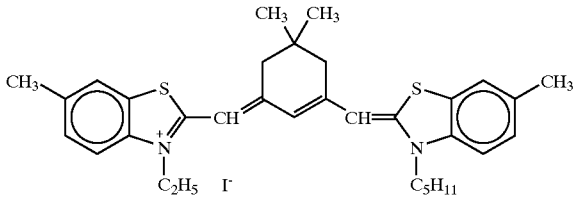

Sensitizing dye H:

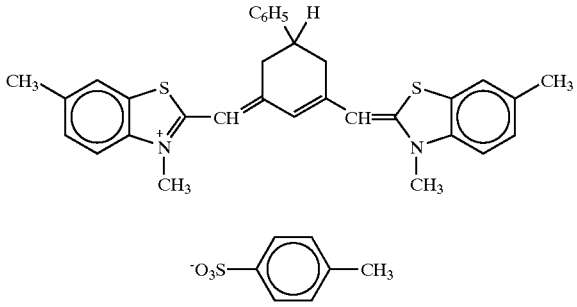

To the red-sensitive emulsion layer was further added $3.0\times10^{-3}$ mol/mol-AgX of compound I.

Compound I:

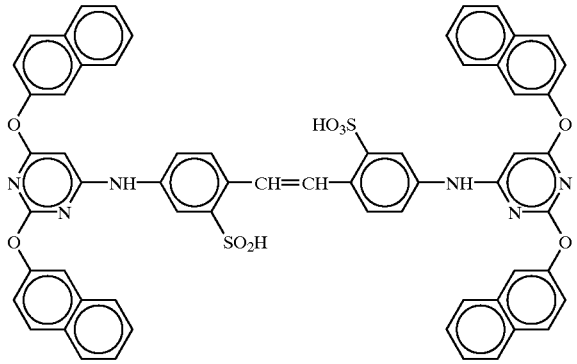

To each of the blue-sensitive, green-sensitive, and red-sensitive emulsion layers was furthermore added 1-(3-methylureidophenyl)-5-mercaptotetrazole in an amount of $3.3\times10^{-4}$ mol, $1.0\times10^{-3}$ mol, and $5.9\times10^{-4}$ mol, respectively, per mol of AgX. The same compound was also added to each of the 2nd, 4th, 6th, and 7th layers in an amount of 0.2 mg/m$^2$, 0.2 mg/m$^2$, 0.6 mg/m$^2$, and 0.1 mg/m$^2$, respectively.

4-Hydroxy-6-methyl-1,3,3a,7-tetraazaindene was added to the blue-sensitive emulsion layer and the green-sensitive emulsion layer in an amount of $1\times10^{-4}$ mol and $2\times10^{-4}$ mol, respectively, per mole of AgX.

To the red-sensitive emulsion layer was added 0.05 g/m$^2$ of a methacrylic acid/butyl acrylate (1:1 by weight) copolymer latex having an average molecular weight of 200,000 to 400,000.

Disodium catechol-3,5-disulfonate was added to the 2nd, 4th and 6th layers in an amount of 6 mg/m$^2$, 6 mg/m$^2$ and 18 mg/m$^2$, respectively.

The following dyes for anti-irradiation were added to the layer (shown below) in the amount (shown below), and each of the dyes was diffused in all layers.

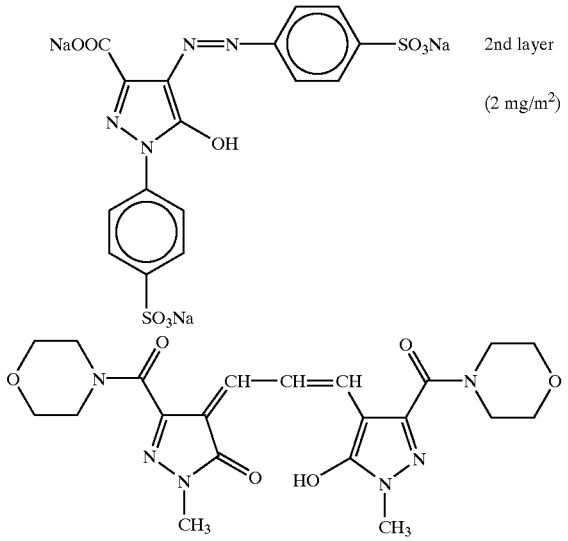

2nd layer (2 mg/m$^2$)

2nd layer (2 mg/m$^2$)

-continued

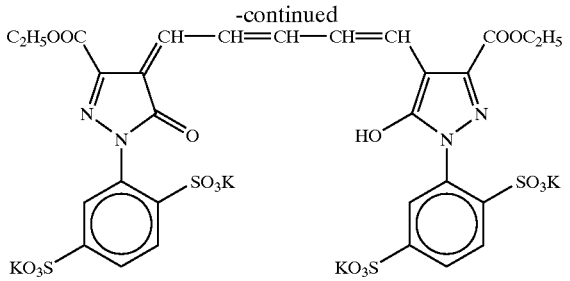

6nd layer (3 mg/m$^2$)

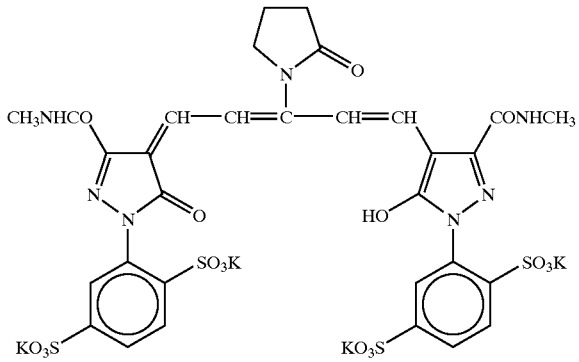

6nd layer (7 mg/m$^2$)

The layer structure of sample 001 is shown below. The amounts shown are coating weights (g) per m$^2$. Those for silver halide emulsions are coating weights in terms of silver. Support:

Polyethylene laminate paper (the polyethylene layer on the side to be coated with a first layer contained a white pigment (16% $TiO_2$ and 4% ZnO), a fluorescent whitening agent (4,4'-bis(5-methylbenzoxazolyl)stilbene; 0.03%) and a blue tingeing dye (ultramarine).

| | |
|---|---|
| 1st Layer (blue-sensitive emulsion layer): | |
| Emulsion A [1:1 (Ag molar ratio) mixture of larger size emulsion (avg. grain size: 0.7 μm; coefficient of size variation: 10%) and smaller size emulsion (avg. grain size: 0.41 μm; coefficient of size variation: 8%); the two emulsions being equivalent except for grain size] | 0.24 g-Ag |
| Gelatin | 1.25 g |
| Yellow coupler Ex Y | 0.57 g |
| Dye image stabilizer Cpd-1 | 0.07 g |
| Dye image stabilizer Cpd-2 | 0.04 g |
| Dye image stabilizer Cpd-3 | 0.07 g |
| Dye image stabilizer Cpd-8 | 0.02 g |
| Solvent Solv-1 | 0.21 g |
| 2nd layer (color mixture preventive layer): | |
| Gelatin | 0.99 g |
| Color mixture preventive Cpd-4 | 0.09 g |
| Dye image stabilizer Cpd-5 | 0.018 g |
| Dye image stabilizer Cpd-6 | 0.13 g |
| Dye image stabilizer Cpd-7 | 0.01 g |
| Solvent Solv-1 | 0.06 g |
| Solvent Solv-2 | 0.22 g |

-continued

| | |
|---|---|
| 3rd Layer (green-sensitive emulsion layer): | |
| Silver chlorobromide emulsion B [1:3 (Ag molar ratio) mixture of larger size emulsion (cubic; gold/sulfur sensitized; avg. grain size: 0.45 μm; coefficient of size variation: 10%) and smaller size emulsion (cubic; gold/sulfur sensitized; avg. grain size: 0.35 μm; coefficient of size variation: 8%); both emulsions containing 0.15 mol % of AgI in the vicinity of grain surface and having 0.4 mol % of AgBr localized on grain surface] | 0.14 g-Ag |
| Gelatin | 1.36 g |
| Magenta coupler Ex M | 0.15 g |
| UV absorber UV-A | 0.14 g |
| Dye image stabilizer Cpd-2 | 0.02 g |
| Dye image stabilizer Cpd-4 | 0.002 g |
| Dye image stabilizer Cpd-6 | 0.09 g |
| Dye image stabilizer Cpd-8 | 0.02 g |
| Dye image stabilizer Cpd-9 | 0.03 g |
| Dye image stabilizer Cpd-10 | 0.01 g |
| Dye image stabilizer Cpd-11 | 0.0001 g |
| Solvent Solv-3 | 0.11 g |
| Solvent Solv-4 | 0.22 g |
| Solvent Solv-5 | 0.20 g |
| 4th Layer (color mixing preventive layer): | |
| Gelatin | 0.71 g |
| Color mixture preventive Cpd-4 | 0.06 g |
| Dye image stabilizer Cpd-5 | 0.013 g |
| Dye image stabilizer Cpd-6 | 0.10 g |
| Dye image stabilizer Cpd-7 | 0.007 g |
| Solvent Solv-1 | 0.04 g |
| Solvent Solv-2 | 0.16 g |
| 5th Layer (red-sensitive emulsion layer) | |
| Silver chlorobromide emulsion C [5:5 (Ag molar ratio) mixture of larger size emulsion (cubic; gold/sulfur-sensitized; avg. grain size: 0.40 μm; coefficient of size variation: 9%) and smaller size emulsion (cubic; gold/sulfur-sensitized; avg. grain size: 0.30 μm; coefficient of size variation: 11%); both emulsions containing 0.1 mol % of AgI in the vicinity of grain surface and having 0.8 mol % of AgBr localized on grain surface] | 0.12 g-Ag |
| Gelatin | 1.11 g |
| Cyan coupler ExC-2 | 0.13 g |
| Cyan coupler ExC-3 | 0.03 g |
| Dye image stabilizer Cpd-1 | 0.05 g |
| Dye image stabilizer Cpd-6 | 0.06 g |
| Dye image stabilizer Cpd-7 | 0.02 g |
| Dye image stabilizer Cpd-9 | 0.04 g |
| Dye image stabilizer Cpd-10 | 0.01 g |
| Dye image stabilizer Cpd-14 | 0.01 g |
| Dye image stabilizer Cpd-15 | 0.12 g |
| Dye image stabilizer Cpd-16 | 0.03 g |
| Dye image stabilizer Cpd-17 | 0.09 g |
| Dye image stabilizer Cpd-18 | 0.07 g |
| Solvent Solv-5 | 0.15 g |
| Solvent Solv-8 | 0.05 g |
| 6th Layer (UV absorbing layer): | |
| Gelatin | 0.46 g |
| UV Absorber UV-B | 0.45 g |
| Compound S1-4 | 0.0015 g |
| Solvent Solv-7 | 0.25 g |
| 7th Layer (protective layer): | |
| Gelatin | 1.00 g |
| Acryl-modified polyvinyl alcohol (degree of modification: 17%) | 0.04 g |
| Liquid paraffin | 0.02 g |
| Surface active agent Cpd-13 | 0.01 g |

Yellow coupler ExY
70:30 (by mole) mixture of
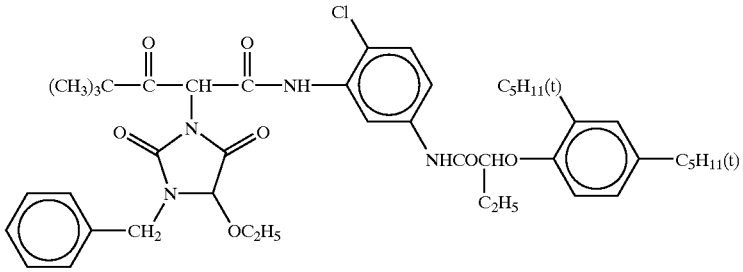
and
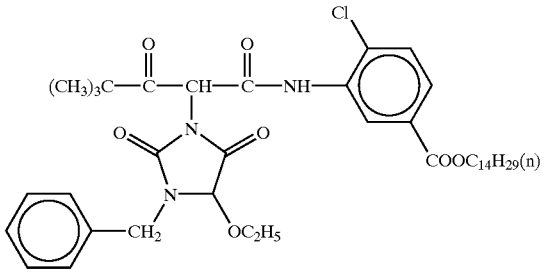
Magneta coupler ExM:
40:40:20 (by mole) mixture of
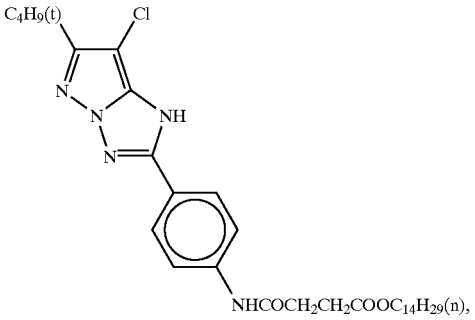
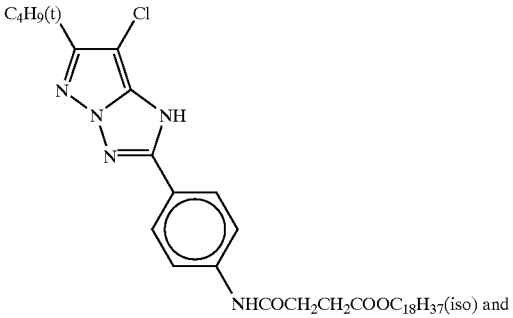
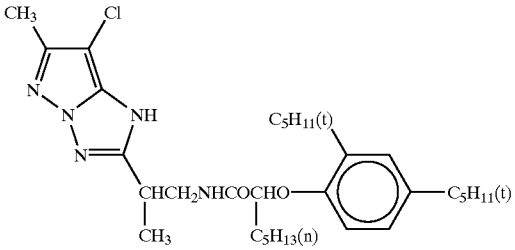
-continued
Cyan coupler ExC-2:
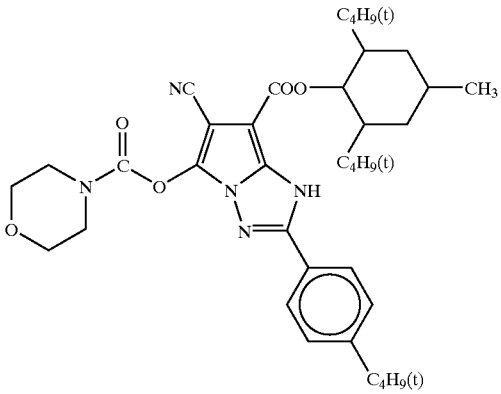
Cyan coupler ExC-3:
50:25:25 (by mole) mixture of
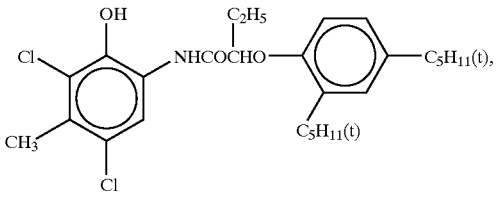
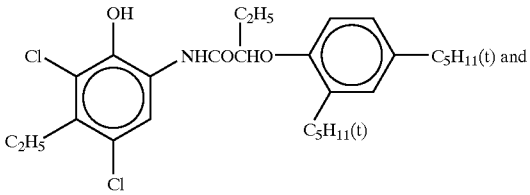

-continued
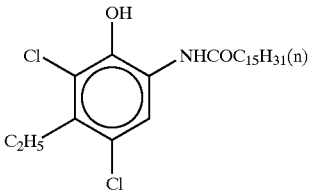
Dye image stabilizer Cpd-1:
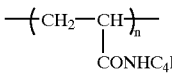
(avg. mol. wt.: 60,000)
Dye image stabilizer Cpd-2:
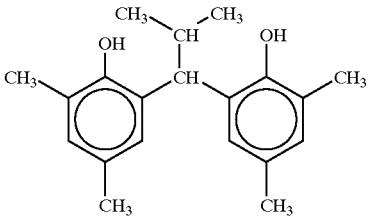
Dye image stabilizer Cpd-3:
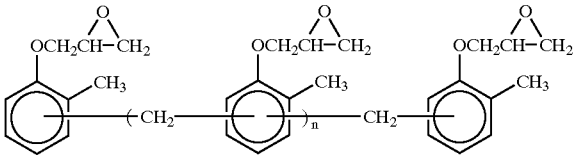
(n = 7 to 8 in average)
Color mixing preventive Cpd-4:
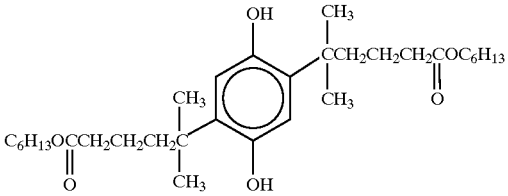
Dye image stabilizer Cpd-5:
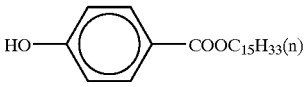
Dye image stabilizer Cpd-6:
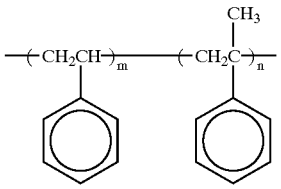
(number avg. mol. wt.: 600; m/n = 10/90)
-continued
Dye image stabilizer Cpd-7:
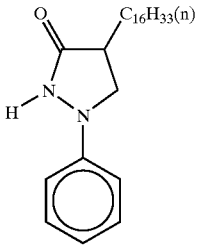
Dye image stabilizer Cpd-8:
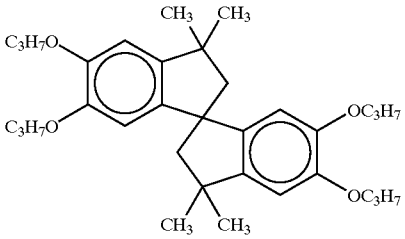
Dye image stabilizer Cpd-9:
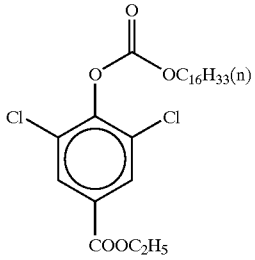
Dye image stabilizer Cpd-10:
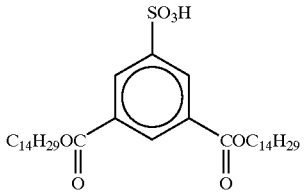
Cpd-11:
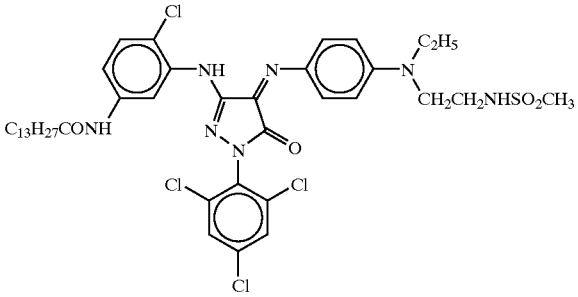

-continued
Surface active agent Cpd-13:
7:3 (by mole) mixture of
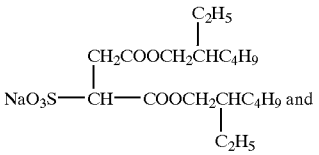
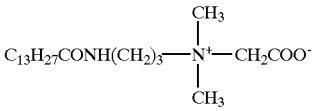
(Cpd-14)
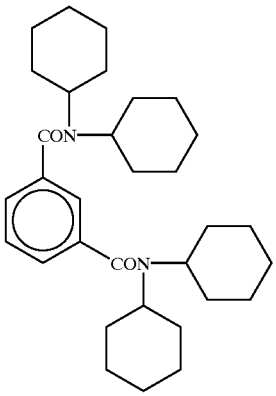
(Cpd-15)
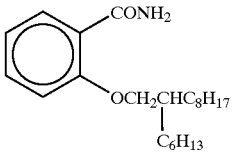
(Cpd-16)
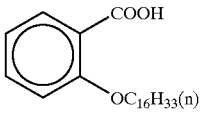
(Cpd-17)
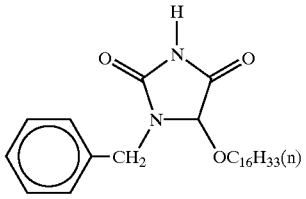
(Cpd-18)
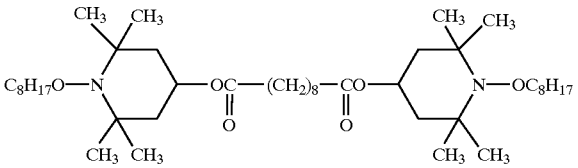
-continued
Color mixing preventive Cpd-19:
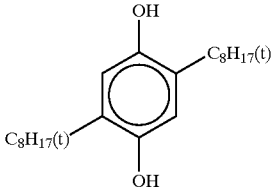
UV-Absorber UV-A:
A 4/2/2/3 (by weight) mixture of UV-1/UV-2/UV-3/UV-4
UV-Absorber UV-B:
A 9/3/3/4/5/3 (by weight) mixture of UV-1/UV-2/UV-3/UV-4/UV-5/UV-6
UV-Absorber UV-C:
A 1/1/1/2 mixture of UV-2/UV-3/UV-6/UV-7
UV-Absorber UV-1:
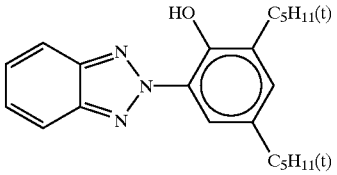
UV-Absorber UV-2:
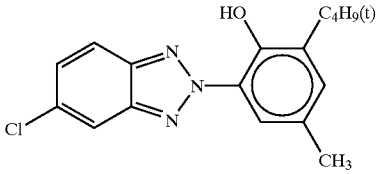
UV-Absorber UV-3:
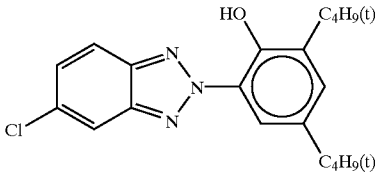
UV-Absorber UV-4:
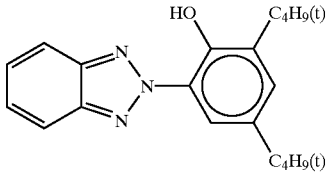

-continued

UV-Absorber UV-5:

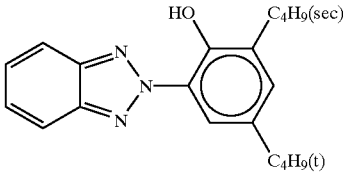

UV-Absorber UV-6:

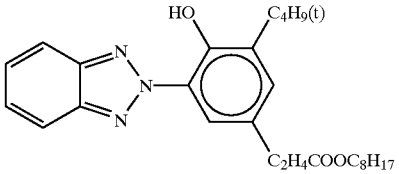

UV-Absorber UV-7:

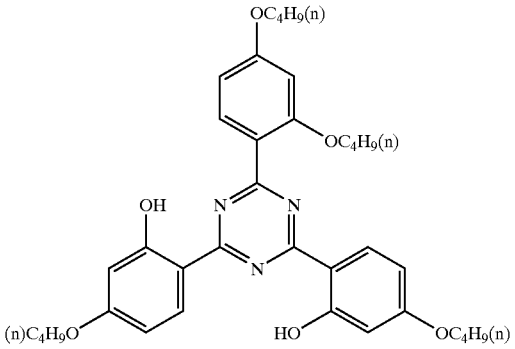

(Solv-1)

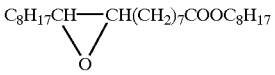

(Solv-2)

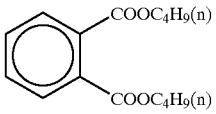

(Solv-3)

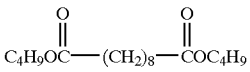

(Solv-4)

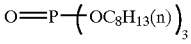

(Solv-5)

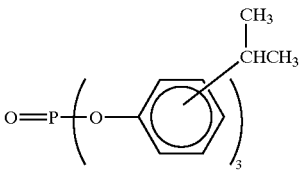

(Solv-7)

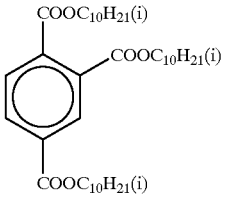

-continued (Solv-8)

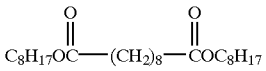

(S1-4)

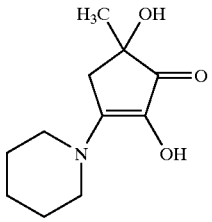

2) Development Processing

The color paper (sample 001) in roll form (width: 127 mm) was loaded into a minilab printer processor Rocky S (PP728), supplied by Fuji Photo Film Co., Ltd. and processed according to the following procedure. Rocky S (PP728) was modified to have a doubled transport speed and an arbitrarily varied air time between a color developing bath and a blix bath.

Development processing:

| Processing Step | Temp. (° C.) | Time (sec) |
|---|---|---|
| Color development | 43.0 | liquid time: 20 (variable air time) |
| Bleach-fix | 38.0 | 25 (liquid time + air time) |
| Rinsing (1) | 38.0 | 12 (liquid time + air time) |
| Rinsing (2) | 38.0 | 12 (liquid time + air time) |
| Rinsing (3) | 38.0 | 12 (liquid time + air time) |
| Rinsing (4) | 38.0 | 9 (liquid time + air time) |
| Drying | 80 | 19 |

The processing solutions used had the following compositions.

Color Developer:

| | |
|---|---|
| Cation exchanged water | 800 ml |
| Dimethyl polysiloxane surface active agent (Silicone KF351A, available from Shin-Etsu Chemical Co., Ltd.) | 0.1 g |
| Triisopropanolamine | 0.2 mol |
| Ethylenediaminetetraacetic acid | 4.0 g |
| Potassium chloride | 10.0 g |
| Potassium bromide | 0.04 g |
| Sodium sulfite | 0.1 g |

Compound P-1 of formula:

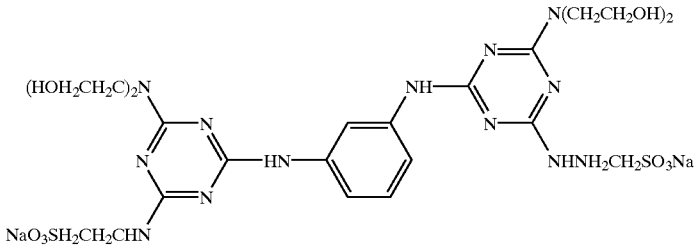

4.0 mmol

Compound S-1 of formula:

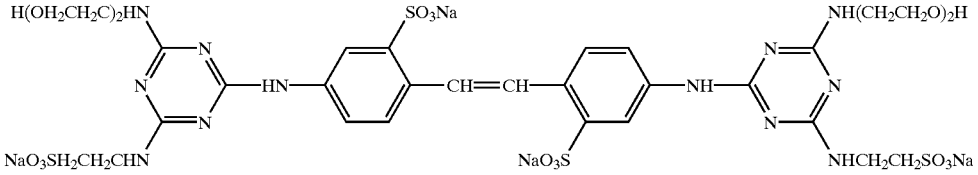

5.0 mole

| | |
|---|---|
| Sodium p-toluenesulfonate | 20.0 g |
| Potassium carbonate | 27.0 g |
| Disodium N,N-bis (sulfonatoethyl)hydroxylamine | 10.0 g |
| N-Ethyl-N-(β-methanesulfonamidoethyl)-3-methyl-4-aminoaniline 3/2 sulfate monohydrate | 5.5 g |
| Water to make | 1000 ml |
| pH (at 25° C.; adjusted with potassium hydroxide and sulfuric acid) | 10.15 |

Blix Bath

| | |
|---|---|
| Water | 600 ml |
| Ammonium thiosulfate (750 g/l) | 110 ml |
| Ammonium sulfite | 40 g |
| Ammonium (ethylenediaminetetraacetato)iron(III) | 50 g |
| Ethylenediaminetetraacetic acid | 5 g |
| Succinic acid | 20 g |
| Water to make | 1000 ml |
| pH (25° C.; adjusted with nitric acid and aqueous ammonia) | 6.0 |

Rinsing Bath

| | |
|---|---|
| Sodium chloroisocyanurate | 0.02 g |
| Deionized water (conductivity: 5 μs/cm or less) | 1000 ml |
| pH | 6.5 |

The air time in the color development step (i.e., the time for the color paper from coming out of the color developer to entering the blix bath) was varied to result in the air time ratio shown in Table 1 below. The compound of formula (I) shown in Table 1 was added to the color developer. After the processing, the edge stains of the resulting prints was evaluated as follows.

Evaluation of Edge Stains

Twenty prints immediately after processing without an exposure were stacked up, and the yellow reflective density of the cut edges of the stack, which was taken as an indication of edge stains, was measures with a Macbeth denistometer. The same measurement was made on the prints after being stored at 60° C. and 70% RH for 5 days. the results obtained are shown in Table 1.

TABLE 1

| | Additive to Color Developer | | Air Time Ratio | Yellow Reflective Density of Edges | | |
|---|---|---|---|---|---|---|
| Run No. | Kind | Amount (mmol/l) | in Color Development (%) | Immed. after Processing | 70° C., 80% RH × 5 Dys. | Remark |
| 1 | I-46 | 30 | 30 | 0.332 | 0.502 | comparison |
| 2 | I-46 | 30 | 5 | 0.310 | 0.489 | " |
| 3 | I-46 | 30 | 10 | 0.109 | 0.298 | invention |
| 4 | I-46 | 30 | 20 | 0.108 | 0.290 | " |
| 5 | I-46 | 30 | 30 | 0.088 | 0.230 | " |
| 6 | I-46 | 30 | 40 | 0.089 | 0.229 | " |
| 7 | I-46 | 30 | 50 | 0.265 | 0.458 | comparison |
| 8 | I-51 | 30 | 30 | 0.113 | 0.301 | invention |
| 9 | I-40 | 30 | 30 | 0.120 | 0.308 | " |
| 10 | I-42 | 30 | 30 | 0.118 | 0.306 | " |

As is proved by the results in Table 1, edge staining is appreciably reduced as indicated by the low yellow density of the cut edges by using a developing solution containing the sulfinic acid compound according to the present invention and setting the air time ratio of the color development step in a range of 10 to 40%. When the developing solution does not contain the sulfinic acid compound and/or the transfer condition is not such as to satisfy the air time ratio condition, the prints undergo considerable edge staining. It is thus understood that the combination of the sulfinic acid compound and the air time ratio produces a specific preventive effect on edge staining. It is seen that the compounds represented by formula (I-a), particularly 3,5-dicarboxybenzenesulfinic acid and m-carboxybenzenesulfinic acid, especially the latter, are preferred among the compounds represented by formula (I). It is also seen that an air time ratio of 30 to 40% is particularly preferred.

EXAMPLE 2

1) Development Processing

The color paper of Example 1 (sample 001) in roll form (width: 127 mm) was loaded into a minilab printer processor Frontier 350, supplied by Fuji Photo Film Co., Ltd. and processed according to the following procedure. Frontier 350 was modified to have an arbitrarily varied transport speed and an arbitrarily varied air time between a color developing bath and a blix bath.

Development processing:

| Processing Step | Temp. (° C.) | Time (sec) |
|---|---|---|
| Color development | 45.0 | liquid time: 10 (variable air time) |
| Bleach-fix | 40.0 | 15 (liquid time + air time) |
| Rinsing (1) | 40.0 | 5 (liquid time + air time) |
| Rinsing (2) | 40.0 | 5 (liquid time + air time) |
| Rinsing (3) | 40.0 | 5 (liquid time + air time) |
| Rinsing (4) | 40.0 | 5 (liquid time + air time) |
| Drying | 90 | 10 |

The processing solutions used had the following compositions.

Color Developer

| | |
|---|---|
| Cation exchanged water | 800 ml |
| Dimethyl polysiloxane surface active agent (Silicone KF351A, available from Shin-Etsu Chemical Co., Ltd.) | 0.1 g |
| Triisopropanolamine | 0.2 mol |
| Ethylenediaminetetraacetic acid | 4.0 g |
| Potassium chloride | 10.0 g |
| Potassium bromide | 0.04 g |
| Sodium sulfite | 0.1 g |
| Compound P-1 (the same as in Example 1) | 6.0 mmol |
| Compound S-1 (the same as in Example 1) | 8.0 mmol |
| Sodium p-toluenesulfonate | 20.0 g |
| Potassium carbonate | 27.0 g |
| Disodium N,N-bis(sulfonatoethyl)hydroxylamine | 15.0 g |
| N-Ethyl-N-(β-methanesulfonamidoethyl)-3-methyl-4-aminoaniline 3/2 sulfate monohydrate | 7.0 g |
| Water to make | 1000 ml |
| pH (at 25° C.; adjusted with potassium hydroxide and sulfuric acid) | 10.15 |

Blix Bath

| | |
|---|---|
| Water | 600 ml |
| Ammonium thiosulfate (750 g/l) | 130 ml |
| Ammonium sulfite | 60 g |
| Ammonium (ethylenediaminetetraacetato)iron(III) | 60 g |
| Ethylenediaminetetraacetic acid | 6 g |
| Succinic acid | 30 g |
| Water to make | 1000 ml |
| pH (25° C.; adjusted with nitric acid and aqueous ammonia) | 6.0 |

Rinsing Bath

| | |
|---|---|
| Sodium chloroisocyanurate | 0.02 g |
| Deionized water (conductivity: 5 μs/cm or less) | 1000 ml |
| pH | 6.5 |

The air time in the color development step (i.e., the time for the color paper from coming out of the color developer to entering the blix bath) was varied to vary the air time ratio as shown in Table 2 below. The transport speed was also varied as shown in Table 2. The compound shown in Table 2 was added to the color developer. Sample 001 in roll form was processed as unexposed in the above-described automatic print processor, and edge staining of the resulting prints was evaluated in the same manner as in Example 1. The results obtained are shown in Table 2.

TABLE 2

| Run No. | Additive to Color Developer: Kind | Additive to Color Developer: Amount (mmol/l) | Air Time Ratio in Color Development (%) | Transfer Speed (mm/sec) | Yellow Reflective Density of Edges: Immed. after Processing | Yellow Reflective Density of Edges: 80° C., 70% RH × 5 Dys. | Remark |
|---|---|---|---|---|---|---|---|
| 1 | — | — | 30 | 15 | 0.396 | 0.638 | comparison |
| 2 | I-46 | 30 | 30 | 15 | 0.118 | 0.318 | invention |
| 3 | I-46 | 30 | 30 | 25 | 0.091 | 0.249 | " |
| 4 | I-46 | 30 | 30 | 35 | 0.090 | 0.250 | " |
| 5 | I-46 | 30 | 30 | 50 | 0.095 | 0.261 | " |
| 6 | I-46 | 30 | 30 | 60 | 0.120 | 0.329 | " |

The results in Table 2 prove that edge staining is prevented as indicated by the low yellow density of the cut edges when a developing solution contains the sulfinic acid compound according to the present invention, and the air time ratio in the color development step is in the specific range. When the developing solution does not contain the sulfinic acid compound, the prints undergo considerable edge staining. It is thus understood that the combination of the sulfinic acid compound and the specific air time ratio produces a specific effect. It is also seen that a processor transfer speed of 20 to 50 mm/sec is particularly preferred.

Separately from the above-described experimentation, it was confirmed that direct addition of the sulfinic acid compound of the invention to a color developing tank of the automatic processor is equal in effects to use of a prepared developing solution which previously contained the compound.

The method of processing a color photographic material according to the invention, which is characterized by using a developing solution containing the compound of formula (I) and adjusting the air time ratio in color development with an automatic processor within a range of 10 to 40%, effectively suppresses edge staining of polyethylene-laminated paper support of a processed photographic material. The method of the invention achieves both edge stain prevention and processing time reduction.

The entire disclosure of each and every foreign patent application from which the benefit of foreign priority has been claimed in the present application is incorporated herein by reference, as if fully set forth.

What is claimed is:

1. A method for processing a silver halide color photosensitive material, which comprises developing the silver halide color photosensitive material with a color developer containing a compound represented by formula (I):

$$RSO_2M \quad \text{(I)}$$

wherein R represents an alkyl group, a cycloalkyl group, an alkenyl group, an alkynyl group, an aralkyl group or an aryl group; and M represents a hydrogen atom, an alkali metal atom, an ammoniumyl group or a quaternary amino group, wherein the silver halide color photosensitive material is processed in an automatic processor having an air time ratio of 10 to 40% in the color development.

2. The method for processing a silver halide color photosensitive material according to claim 1, wherein R in formula (I) represents an aryl group containing a carboxyl group.

3. The method for processing a silver halide color photosensitive material according to claim 1, wherein the compound represented by formula (I) is a compound represented by formula (I-a):

(I-a)

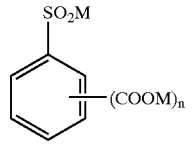

wherein M represents a hydrogen atom, an alkali metal atom, an ammoniumyl group or a quaternary amino group; and n represents an integer of 1 to 5.

4. The method for processing a silver halide color photosensitive material according to claim 3, wherein the compound represented by formula (I-a) is at least one of m-carboxybenzenesulfinic acid and a salt of m-carboxybenzenesulfinic acid.

5. The method for processing a silver halide color photosensitive material according to claim 1, wherein the color developer contains the compound represented by formula (I) in an amount of 0.001 to 1 mol per liter of the color developer.

6. The method for processing a silver halide color photosensitive material according to claim 1, wherein the air time ratio is 15 to 40%.

7. The method for processing a silver halide color photosensitive material according to claim 1, wherein the air time ratio is 30 to 40%.

8. The method of processing a silver halide color photosensitive material according to claim 1, wherein the air time ratio (%) in the color development is defined by formula: $(T2/T1)\cdot 100$, wherein T1 represents a time period from the immersion of the silver halide color photosensitive material in the color developer to the immersion of the silver halide color photosensitive material in a processing solution of the next processing step; T2 represents a time period from the time at which the silver halide color photosensitive material comes out of the color developer to the immersion of the silver halide color photosensitive material in a processing solution of the next processing step.

9. The method for processing a silver halide color photosensitive material according to claim 1, wherein the automatic processor has a transport speed of 20 to 50 mm/sec.

10. The method for processing a silver halide color photosensitive material according to claim 1, wherein the silver halide color photosensitive material comprises a paper support having a water-resistant resin layer.

11. The method of processing a silver halide color photosensitive material according to claim 10, wherein the water-resistant resin layer is a polyethylene layer.

12. The method for processing a silver halide color photosensitive material according to claim 1, wherein the silver halide color photosensitive material is a photosensitive material for a color printing paper.

* * * * *